US009642401B2

(12) United States Patent
Yamada et al.

(10) Patent No.: US 9,642,401 B2
(45) Date of Patent: May 9, 2017

(54) LOWER-BODY GARMENT

(71) Applicant: WACOAL CORP., Kyoto-shi, Kyoto (JP)

(72) Inventors: Takato Yamada, Kyoto (JP); Yumiko Tanmatsu, Kyoto (JP); Yuka Kitagawa, Kyoto (JP)

(73) Assignee: WACOAL CORP., Kyoto-Shi, Kyoto (JP)

( * ) Notice: Subject to any disclaimer, the term of this patent is extended or adjusted under 35 U.S.C. 154(b) by 99 days.

(21) Appl. No.: 14/386,664

(22) PCT Filed: Mar. 15, 2013

(86) PCT No.: PCT/JP2013/057455

§ 371 (c)(1),
(2) Date: Sep. 19, 2014

(87) PCT Pub. No.: WO2013/141162

PCT Pub. Date: Sep. 26, 2013

(65) Prior Publication Data

US 2015/0074865 A1 Mar. 19, 2015

(30) Foreign Application Priority Data

Mar. 23, 2012 (JP) ..... P2012-066962

(51) Int. Cl.
*A41D 13/05* (2006.01)
*A41D 13/06* (2006.01)
*A41D 13/00* (2006.01)

(52) U.S. Cl.
CPC ..... *A41D 13/0506* (2013.01); *A41D 13/0015* (2013.01); *A41D 13/065* (2013.01)

(58) Field of Classification Search
CPC ..... A41D 13/0506; A41D 13/0015; A41D 13/065
See application file for complete search history.

(56) References Cited

U.S. PATENT DOCUMENTS 5,201,074 A * 4/1993 Dicker ..... A41D 13/0015 2/227
5,263,923 A * 11/1993 Fujimoto ..... A41D 13/0015 602/62

(Continued)

FOREIGN PATENT DOCUMENTS

CN 1232369 A 10/1999
CN 1380814 A 11/2002

(Continued)

OTHER PUBLICATIONS

Chinese Patent Office, Office Action in counterpart Chinese Application No. 201380015966.6, mailed Dec. 15, 2015.

(Continued)

*Primary Examiner* — Anna Kinsaul
(74) *Attorney, Agent, or Firm* — Jeremy Jay

(57) ABSTRACT

On the front side of the main part, the first start part separates the main part into a portion covering a knee joint of a wearer and a portion covering at least one of femoral and shin parts of the wearer. On the back side of the main part, the second start part separates the main part into a portion covering the knee joint of the wearer and a portion covering at least one of the femoral and shin parts of the wearer. On an outer side face side of the main part, the third start part at least partly extends under the portion covering the knee joint of the wearer. On an inner side face side of the main part, the fourth start part at least partly extends downward in a part lower than a crotch part of the wearer.

6 Claims, 30 Drawing Sheets

(56) References Cited

U.S. PATENT DOCUMENTS

| | | | | |
|---|---|---|---|---|
| 6,231,488 | B1 * | 5/2001 | Dicker | A41D 13/0015 2/69 |
| 7,229,390 | B2 * | 6/2007 | Fujii | A41D 13/0015 2/2.16 |
| 7,516,498 | B2 * | 4/2009 | Torry | A41D 1/08 2/69 |
| 8,533,864 | B1 * | 9/2013 | Kostrzewski | A41D 13/0015 2/69 |
| 9,326,554 | B2 * | 5/2016 | Lou | A41D 1/06 |
| 2004/0255358 | A1 * | 12/2004 | Ota | A41D 13/0015 2/69 |
| 2008/0295216 | A1 * | 12/2008 | Nordstrom | A41D 13/0015 2/69 |
| 2009/0007311 | A1 * | 1/2009 | Semba | A41D 1/08 2/69 |

FOREIGN PATENT DOCUMENTS

| | | | |
|---|---|---|---|
| CN | 1774185 | A | 5/2006 |
| CN | 1806706 | A | 7/2006 |
| JP | 2000-0328305 | A | 11/2000 |
| JP | 2004-004070 | A | 2/2004 |
| JP | 2004-238789 | A | 8/2004 |
| JP | 2005-248389 | A | 9/2005 |
| JP | 2007-197877 | A | 8/2007 |
| JP | 2010-275644 | A | 12/2010 |
| JP | 2011-021291 | A | 2/2011 |
| JP | 2011-038230 | A | 2/2011 |

OTHER PUBLICATIONS

International Preliminary Report on Patentability, Application No. PCT/JP2013/057455, dated Sep. 23, 2014.

International Search Report, International Application No. PCT/JP2013/057455 mailed Apr. 16, 2013.

Japanese Patent Office, Office Action in counterpart Japanese Application No. P2012-066962, mailed Jan. 17, 2017.

* cited by examiner (a)

(b)

(a) (b)

LOWER-BODY GARMENT

TECHNICAL FIELD

The present invention relates to a lower-body garment.

BACKGROUND ART

Known as an example of techniques relating to this kind of field is an undershirt disclosed in Patent Literature 1. This conventional undershirt uses three kinds of materials having different tightening forces, in which the material having the highest tightening force is applied to at least a part of the triceps brachii muscles, the material having the lowest tightening force is applied to at least a part of the trapezius, latissimus dorsi, and deltoid muscles about shoulder blades, and a material having the middle tightening force is applied to the remaining regions. On the other hand, a shirt disclosed in Patent Literature 2, for example, uses a unidirectionally stretchable material and arranges the material such that the expanding/contracting direction varies among upper and lower parts of the back body, the front body, upper arm parts, sides to elbow parts, and sleeve parts.

CITATION LIST

Patent Literature

Patent Literature 1: Japanese Patent Application Laid-Open No. 2004-044070

SUMMARY OF INVENTION

Technical Problem

Conventional garments such as those mentioned above mainly aim to stabilize joints and muscles when wearers move or to keep such motions from being disturbed. While these are meaningful from the viewpoint of supporting the motions of wearers, further contrivances are needed for providing such a function as to enable the wearers to move smoothly and make their various motions appear beautiful. Inducing the wearers to move smoothly and make their motions appear beautiful by a new technique seems to result in improving athletic abilities in various kinds of sports such as tennis, golf, baseball, and running.

For solving the problem mentioned above, it is an object of the present invention to provide a lower-body garment which enables its wearer to move smoothly and can make motions appear beautiful.

Solution to Problem

In the process of diligent studies for achieving the above-mentioned object, the inventors of the present application have focused attention on the fact that motions of a human body are closely related not only to bones and muscles, but also to characteristics of the skin covering their surfaces. Here. FIGS. 28 and 29 are diagrams illustrating examples of inherent movements of the skin accompanying motions of joints of the human body (see FUKUI Tsutomu, *Skin Kinematics*, Miwa-Shoten Ltd.). When a knee joint bends, for example, the skin on the front side of a knee gathers at the knee joint while the skin on the back side of the knee leaves the knee joint as illustrated in FIG. 28(*a*). When the knee joint stretches, for example, the skin on the front side of the knee leaves the knee joint while the skin on the back side of the knee gathers at the knee joint, contrary to what occurring upon bending, as illustrated in FIG. 28(*b*).

When, a hip joint is abducted, for example, the skin moves upward and downward away from about the greater trochanter as illustrated in FIG. 29(*a*). When the hip joint is adducted, for example, the skin moves so as to gather about the greater trochanter as illustrated in FIG. 29(*b*).

However, if the skin gathers to wrinkle or leaves a joint of a human body to stretch differently from such inherent skin movements when the joint works, the motion of the joint may become narrower in range or inhibited.

Next, the inventors have looked at the appearance of the lower body in the running motion of the human body. FIG. 30 is a set of diagrams illustrating the state of the lower body of a runner on a treadmill. FIG. 30(*a*) illustrates a normal running posture and a running posture with hips flowing laterally outward from the body by a solid line and a dash-double-dot line, respectively. Runners with waste in motions tend to put their weight on the foot on the ground, thereby causing the hips to flow laterally outward from the body as illustrated in FIG. 30(*a*). Their hip and knee joints also tend to move out of synchronization with each other, thereby causing the body to jump up as illustrated in FIG. 30(*h*) instead of advancing.

Hence, the inventors have found that, if a structure for supporting movements of the skin such as to suppress waste motions occurring when the human body moves is added to a garment, motions of the wearer can be made smooth and appear beautiful by a new technique totally different from the techniques exerting tightening forces on muscles, thereby achieving the present invention.

The lower-body garment in accordance with the present invention comprises a main part, formed from an elastic material, for coming into close contact with a skin of at least one of femoral and shin parts and biasing the skin in an expanding/contracting direction; and an expansion/contraction start part, relatively less elastic than the main part, for acting as a start point for expanding/contracting the main part when worn; the expansion/contraction start part having at least one of a first start part on a front side of the main part for separating the main part into a portion covering a knee joint of a wearer and a portion covering at least one of femoral and shin parts of the wearer, a second start part on a back side of the main part for separating the main part into a portion covering the knee joint of the wearer and a portion covering at least one of the femoral and shin parts of the wearer, a third start part on an outer side face side of the main part at least partly extending under the portion covering the knee joint of the wearer, and a fourth start part on an inner side face side of the main part at least partly extending downward in a part lower than a crotch part of the wearer.

In this lower-body garment, when worn, the main part extends from the expansion/contraction start part acting as a start point, whereby the skin of the wearer can be moved by a force by which, the main part contracts toward the expansion/contraction start part. On the front side of the main part, the first start part acts to separate a fabric of the main part covering the knee joint, and a fabric of the main part covering the femoral part from each other, so as to expand the skin about the crotch part toward the knee joint, or separate a fabric of the main part covering the knee joint and a fabric of the main part and a fabric of the main part covering the shin part from each other, so as to expand the skin about an ankle part toward the knee joint. The second start part acts similarly on the back side of the main part. This enables the hip and knee joints to move smoothly, thereby restraining the body from jumping up.

On the outer side face side of the main part, the third start part at least partly extends under the portion covering the knee joint of the wearer and pulls down the fabric of the main part about the greater trochanter, so as to expand the skin about the greater trochanter toward the femoral part. As a consequence, the moving area of the femoral part can be shifted more to the outside of the crotch part when the garment is worn than when not. On the inner side face side of the main part, the fourth start part at least partly extends downward in a part lower than the crotch part of the wearer, thereby acting to gather the skin on the inner side face side of a leg toward the crotch part. This makes it harder for the hip joint to be adducted.

The foregoing enables this lower-body garment to suppress waste in motions of the wearer and make the motions appear beautiful.

The shin part stated herein means a region from the knee part to the ankle part.

Preferably, the expansion/contraction part has at least two of the first to fourth start parts and is shaped into a line. This allows the start parts to cooperate with each other, thereby further enhancing their actions.

Preferably, the expansion/contraction part includes a linear part substantially symmetrical along a front-back direction of the main part as seen from the side face side of the main part. Here, the side face side includes the outer and inner side face sides. Such a mode can enhance the force by which the fabric of the main part is pulled by the start part.

Preferably, the first start part is formed so as to traverse the main part circumferentially on at least one of the upper and lower sides of the portion covering the knee joint of the wearer on the front side of the main part. Such a structure can generate the actions of the first start part more securely.

Preferably, the second start part is for led so as to traverse the main part circumferentially on at least one of the upper and lower sides of the portion covering the knee joint of the wearer on the back side of the main part. Such a structure can generate the actions of the second start part more securely.

Preferably, the first start part is formed so as to surround the portion covering the knee joint of the wearer on the front side of the main part. Such a structure can generate the actions of the first start part more securely.

Preferably, the second start part is formed so as to surround the portion covering the knee joint of the wearer on the hack side of the in part. Such a structure can generate the actions of the second start part more securely.

The first start part may be formed so as to cover the knee joint of the wearer instead. Such a configuration can also generate the actions of the first start part.

Preferably, the expansion/contraction start art is formed by partly changing a knitting structure of the main part. This can easily form the expansion/contraction start part.

Preferably, the expansion/contraction start part is formed by applying a resin to the main part. This can easily form the expansion/contraction start part.

Preferably, the expansion/contraction start part is formed by attaching a patch to the main part. This can easily form the expansion/contraction start part.

Preferably, the expansion/contraction start part is formed by subjecting the main part to burn-out printing. This can easily form the expansion/contraction start part.

Advantageous Effects of Invention

The present invention enables the wearer to move smoothly and can make motions appear beautiful.

DESCRIPTION OF EMBODIMENTS

In the following, preferred embodiments of the lower-body garment in accordance with the present invention will be explained in detail with reference to the drawings.

First, findings of the present invention will be explained before the embodiments. In the process of conducting diligent studies, the inventors have paid attention to the fact that moving the skin can bring a change to motions of a human body. For example, the skin at a location where a wrinkle is formed by a motion of a joint in relation to bending/stretching or abduction/adduction of the wearer tends to leave the joint, while the skin at a location n) extend tends to gather at the joint.

The inventors have found that each of these movements is in the same direction as with an inherent skin movement and that adding a structure for promoting these movements to the garment can widen the range of motion of the joint and smooth the motion.

More specifically, when a knee joint bends, wrinkles on the front side of the skin about the knee joint are extended, so as to yield a state where the skin is likely to stiffen. On the back side of the knee joint, on the other hand, a state where the skin is likely to stiffen occurs when the knee joint is extended, e.g., when kicking the ground. These skin stiffening states seem to narrow the moving area of the knee joint and inhibit its motions. Therefore, mitigating these skin stiffening states seems to widen the range of motion of the joint and smooth the motion.

In general, hip joints have been known to be easily adducted under the influence of skeleton forms and the like when running and so forth (women are easier to be adducted than men in particular).

Therefore, the inventors conducted further studies and have found that expanding the skin about the greater trochanters on the outer side face side so as to make it easier to stiffen can restrain the hip joints from being adducted. The inventors have also found that, on the inner side face side, gathering the skin such that wrinkles are likely to shift toward the crotch part can restrain the hip joints from being adducted.

About the hip joints, as mentioned above, making the skin about the grater trochanters easier to stiffen or gathering the skin on the inner side face side about the crotch part can make the hip joints hard to be adducted even when running and the running form appear beautiful.

About the hip joints, wrinkles occurring about the inguinal part (the root of thighs) and gluteal fold also seems to narrow the range of motion in the front-back direction of the hip joints and inhibit, their motions. Therefore, wrinkles about the inguinal part and gluteal fold may be flattened, so as to widen the range of motion of the hip joints and smooth their motions.

Figure 30:
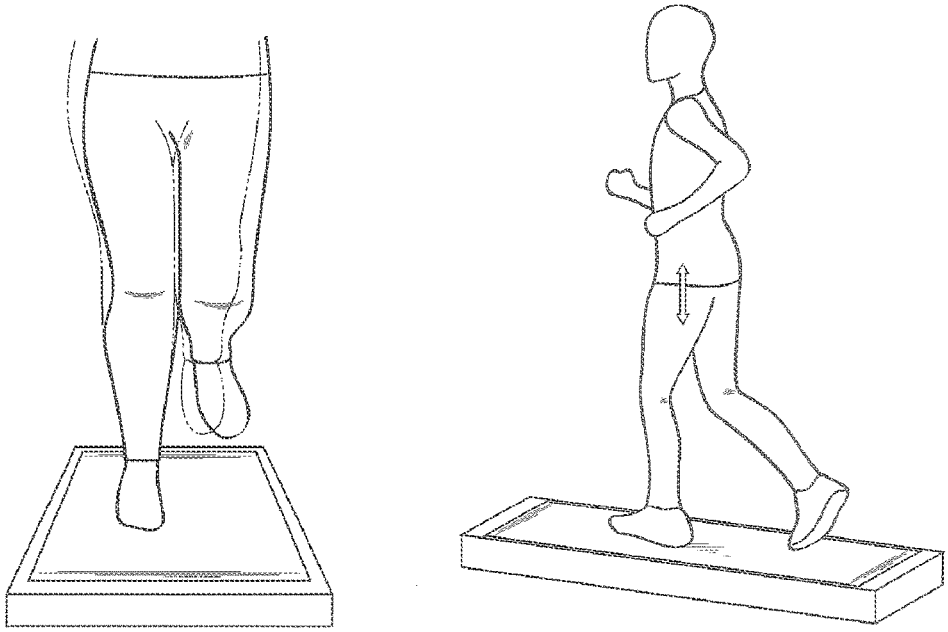
FIG. 30 is a set of diagrams illustrating the state of the lower body of a subject running on a treadmill.

By applying the above-mentioned findings to motions of the human lower body, the inventors have reached a conclusion that adding to a lower-body garment such a structure as to suppress movements of making the hips flow laterally outward from the body and causing the body to jump up as illustrated in FIG. 30 allows the wearer to move smoothly and can make the motions of the wearer appear beautiful.

For actualizing the effects mentioned above, the following embodiments of the lower-body garment are formed so as to exhibit at least one of an effect (effect A) to gather the skin about a knee part toward the knee part while extending the skin about the crutch part toward the knee part on the front side of the wearer, an effect (effect B) to gather the skin about the knee part toward the knee part while extending the skin about the crotch part toward the knee part on the back side of the wearer, an effect (effect C) to extend the skin about a greater trochanter of the wearer toward a femoral part, and an effect (effect D) to gather the skin on the inner side face side of a leg of the wearer toward the crotch part. The effects A to D are respectively indicated by arrows A to D in the drawings.

First Embodiment

Figure 1:
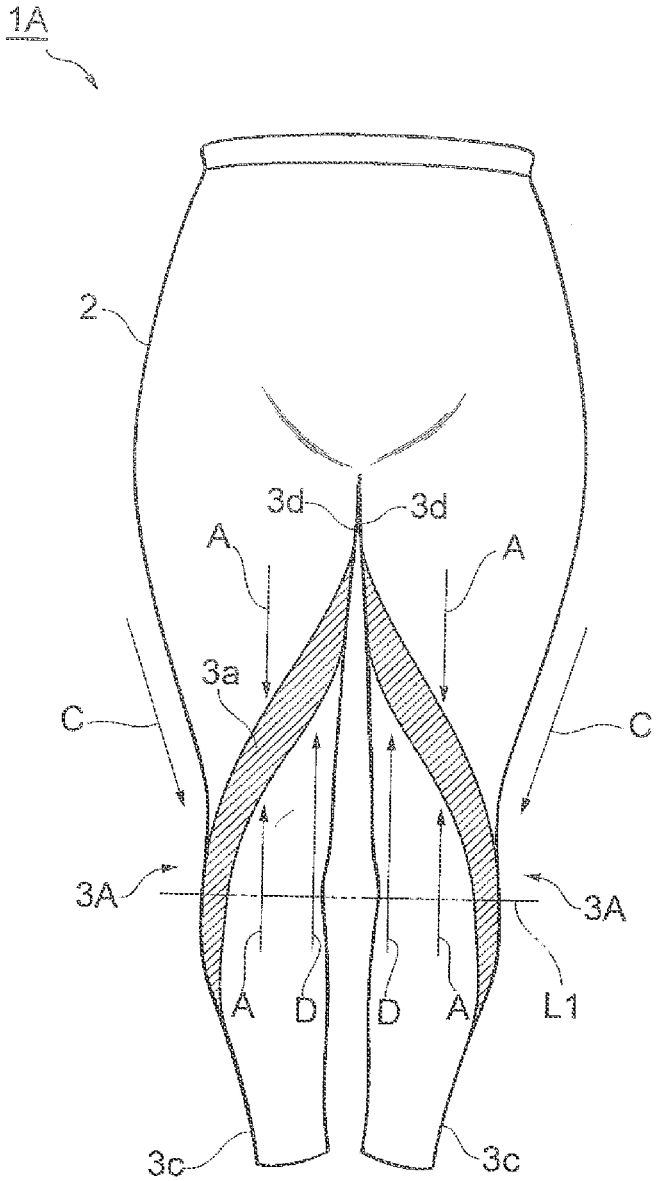
FIG. 1 is a diagram illustrating how the lower-body garment in accordance with a first embodiment of the present invention is worn as seen from the front side.
Figure 2:
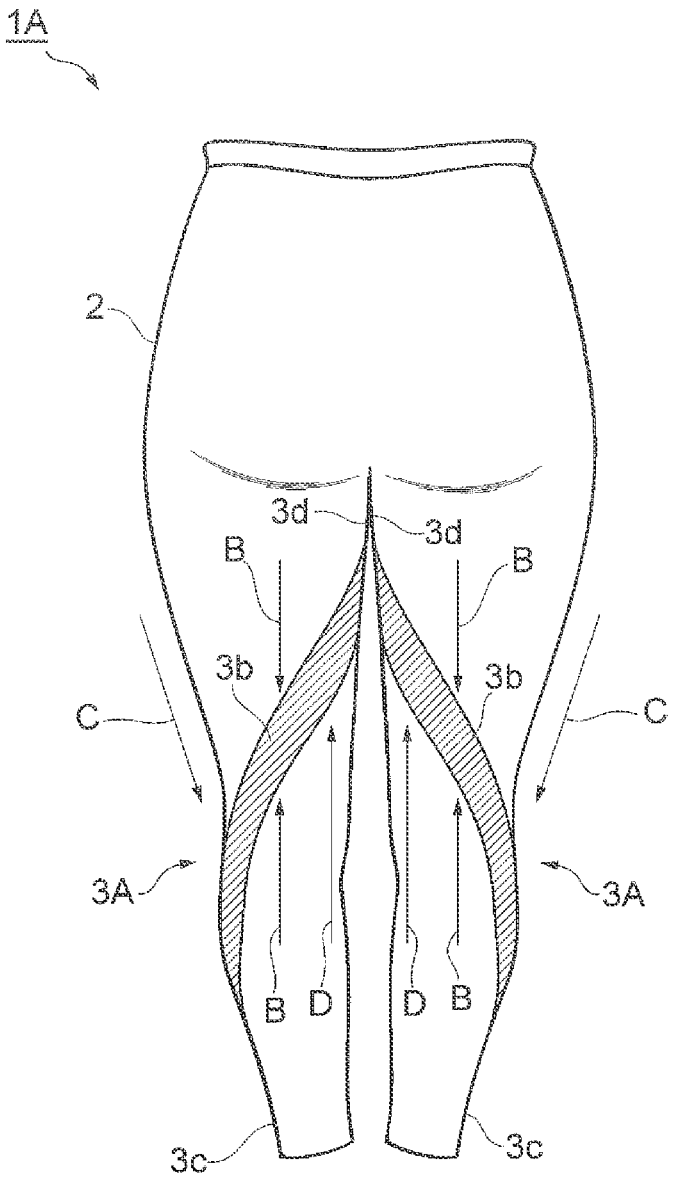
FIG. 2 is a diagram illustrating how the lower-body garment depicted in FIG. 1 is worn as seen from the back side.
Figure 3:
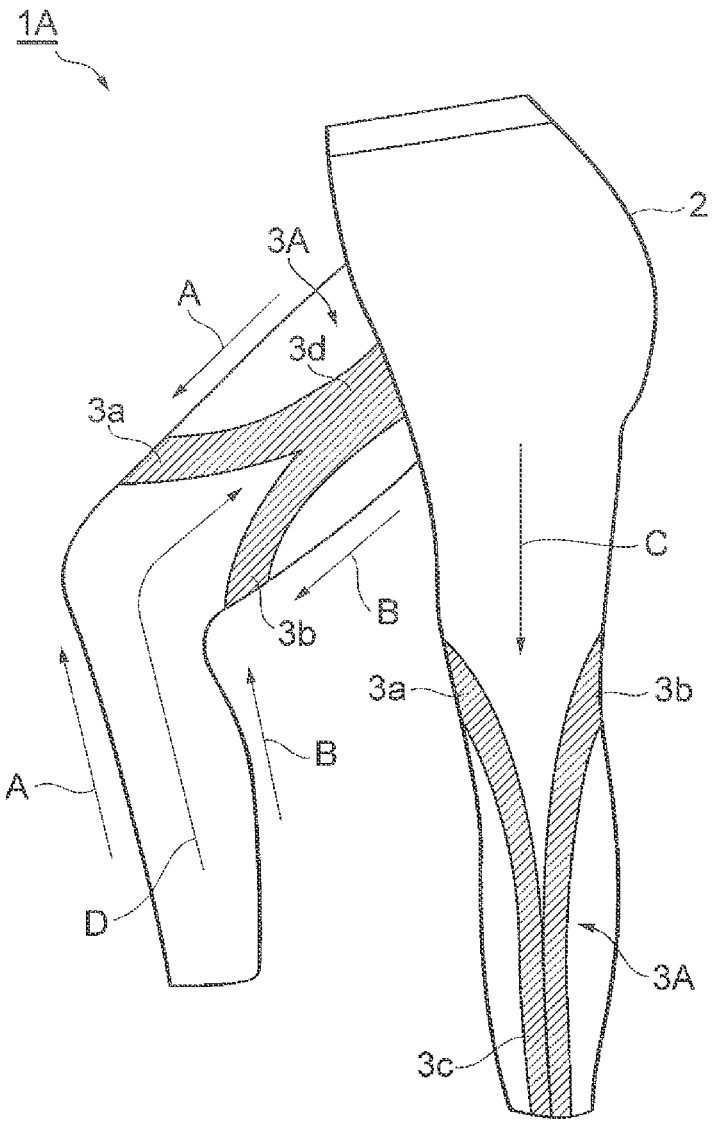
FIG. 3 is a diagram illustrating how the lower-body garment depicted in FIG. 1 is worn as seen from one side face side at the time of a predetermined motion.
Figure 4:
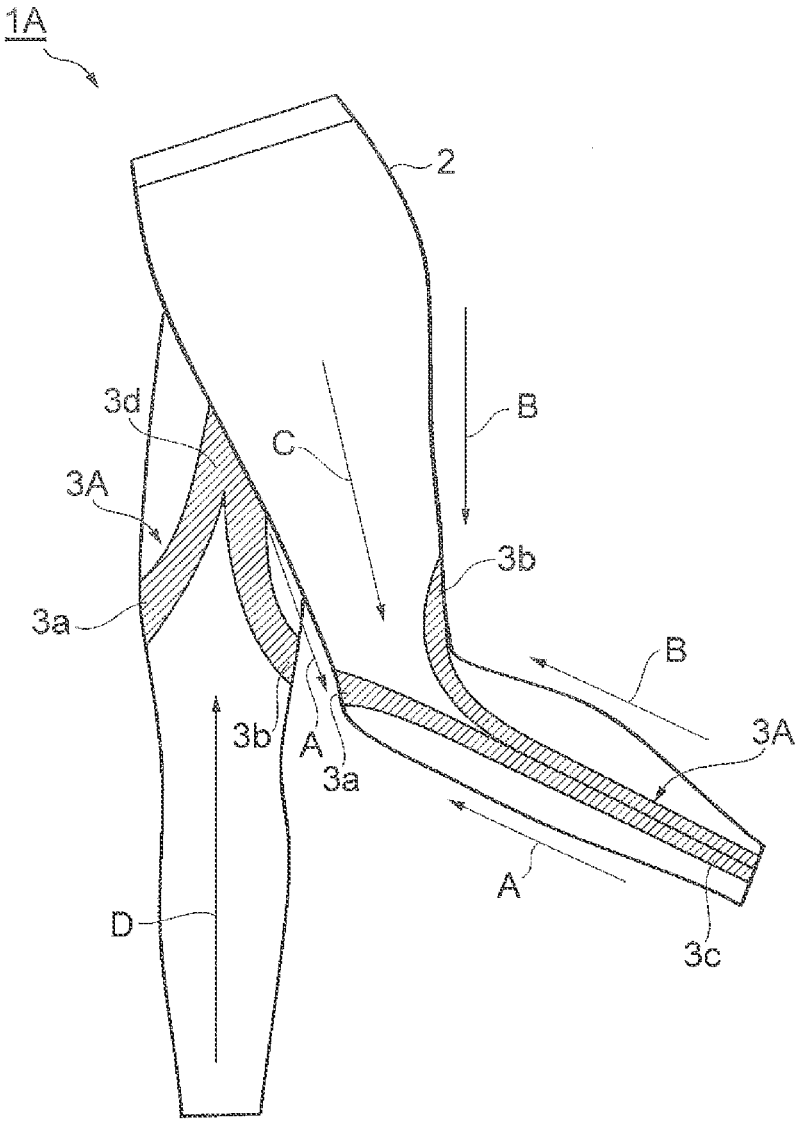
FIG. 4 is a diagram illustrating how the lower-body garment depicted in FIG. 1 is worn as seen from one side face side at the time of another motion.

FIGS. 1 and 2 are diagrams illustrating how the lower-body garment in accordance with the first embodiment of the present invention is worn as seen from the front and back sides, respectively. FIGS. 3 and 4 are diagrams illustrating how the lower-body garment depicted in FIG. 1 is worn as seen from one side face side at the time of a predetermined motion and at the time of another motion, respectively. The lower-body garment 1A illustrated in FIGS. 1 to 4 is constructed as a pair of leggings of a long typo which is worn in order to improve athletic abilities when doing various kinds of sports such as tennis, golf, baseball, and running, for example, and is of a type exhibiting all of the above-mentioned effects A to D (ABCD type).

The lower-body garment 1A comprises a main part 2 which is formed from an elastic material such as to come into close contact with the skin in at least one of femoral and shin parts in the lower body of the wearer, so as to bias the skin in contact therewith in an expanding/contracting direction, and expansion/contraction start parts 3A which are relatively less elastic than the main part 2 and act as start points for expanding/contracting the main part 2 when worn. The main part 2 is constituted by front and back bodies, for example, and formed by sewing them together. The expansion/contraction start parts 3A are formed bilaterally symmetrical to each other so as to correspond to both legs of the wearer.

An example of the material constituting the main part 2 is bare jersey formed by mixing yarns of polyester and polyurethane. Using such a material favorably brings the main part 2 into close contact with the lower body of the wearer.

An example of the material constituting the expansion/contraction start parts 3A is a power net formed by mixing yarns of nylon and polyurethane. While the expansion/contraction start parts 3A may have various forms as will be explained later, their elasticity is preferably lower in the width direction than in the longitudinal direction for making them extend linearly by a predetermined width.

Since the expansion/contraction start parts 3A are less elastic than the main part 2, the more extendable main part 2 extends from the less extendable expansion/contraction start parts 3A acting as start points when worn, and the main part 2 is always apt to contract toward the expansion/contraction start parts 3A. Therefore, the contracting force of the main part 2 can move the skin of the wearer toward the extendable expansion/contraction start parts 3A.

In this embodiment, each expansion/contraction start part 3A is formed into a line extending from the crotch part of the wearer to an ankle part thereof with a width on the order of several cm. More specifically, the expansion/contraction start part 3A extends vertically near the crotch part of the wearer on an inner side face side of the main part 2 and branches into the front and back sides of the main part 2 on the lower side. Under the branching portion, one line turns to the front side of the main part 2, travels obliquely above a knee part of the wearer, turns to an outer side face side of the main part 2, and extends to the ankle part. The other line is routed to the hack side of the main part 2, travels obliquely above the knee part of the wearer, turns to the outer side face side of the main part 2, and extends to the ankle part of the wearer in parallel with the one line. The expansion/contraction start part 3A forms lines which are substantially symmetrical to each other along the front-back direction of the main part 2 when seen from the side face side of the main part 2 (see FIG. 3). Though the main part 2 is formed so as to cover the wearer down to the ankle parts of the wearer, it will be sufficient if the wearer is covered therewith at least from the crotch part to knee joints. For example, hems on the lower end side of the main part 2 may be located at the position of a virtual line L1 indicated by a dash-double-dot line in FIG. 2, i.e., directly under the knee joints. The hems may be located at any position under the virtual line L1. However, the hem is preferably located near the ankles, since the expansion/contraction start part cannot be provided at the shin parts if the hems are located near the knee joints.

In the expansion/contraction start part 3A, a portion located above the knee part on the front side of the main part 2 is a first start part 3*a* which separates the main part 2 into a portion covering the knee joint of the wearer and a portion covering the femoral part of the wearer and gathers the skin about the knee part toward the knee part while extending the skin about the crotch part toward the knee part (see FIG. 1). A portion located above the knee part on the back side of the main part 2 is a second start part 3*b* which separates the main part 2 into a portion covering the knee joint of the wearer and a portion covering the femoral part of the wearer and gathers the skin about the knee part toward the knee part while extending the skin about the crotch, part toward the knee part (see FIG. 2).

In the expansion/contraction start part 3A, a portion located above the ankle part on the outer side face side of the main part 2 is a third start part 3*c* which extends the skin about the greater trochanter toward the femoral part (see FIGS. 3 and 4), while a portion located near the crotch part on the inner side face side of the main part 2 is a fourth start part 3*d*. Which gathers the skin on the inner side face side of a leg of the wearer toward the crotch part (see FIGS. 3 and 4). While each of the third and fourth start parts 3*c*, 3*d* is formed substantially symmetrical as seen in a side view, the present invention is not limited thereto. For example, only one of the third and fourth start parts 3*c*, 3*d* may be formed substantially symmetrical as mentioned above. Both of the third and fourth start parts 3*c*, 3*d* may be kept from being formed substantially symmetrical as mentioned above.

In the lower-body garment 1A, as in the foregoing, the main part 2 extends from the expansion/contraction start parts 3A acting as start points when worn, whereby the skin of the wearer can be moved by the force by which the main part 2 contracts toward the expansion/contraction start parts 3A. In the lower-body garment 1A, the first and second start parts 3*a*, 3*b* can act so as to make the hip and knee joints move smoothly and restrain the body of the wearer from jumping up.

That is, the first start part 3*a* extends wrinkles about the inguinal part (the root of thighs), while the second start part 3*b* flattens wrinkles about the gluteal fold. This can reduce wrinkles about the inguinal part and gluteal fold where wrinkles are likely to gather in the nude state, thereby widening the range of motion of the knee joint in particular, this can reduce wrinkles occurring in the inguinal part when bending the hip joint and those occurring in the gluteal fold when stretching the hip joint.

In contrast, the skin about the knee joint tends to stiffen during exercises such as running and walking, in particular when stepping forward with a leg. As mentioned above, the fact that a tensed state is caused by the stiffening of skin is considered to be one of factors for worsening the motions of the knee joint.

Therefore, the first start part 3*a* biases the skin about the knee toward the knee, so as to mitigate the stiffening of the skin at the time of bending the knee joint, while the second start part 3*b* gathers the skin toward the back side portion of the knee joint from thereabout, thereby mitigating the stiffening of the skin at the time of stretching the knee joint. The first and second start parts 3*a*, 3*b* gather wrinkles to the front side of the knee (which can also be expressed as surroundings of the patella) and the back side of the knee (which can also be expressed as surroundings of the popliteal fossa), thereby mitigating the tensed state caused by the stiffening of the skin on the knee joint.

This enables the hip and knee joints to move smoothly as mentioned above.

In the lower-body garment 1A, the third and fourth start parts 3*c*, 3*d* can act so as to stabilize the motions of the hip joints of the wearer and restrain the hips from flowing laterally outward from the body. This can suppress waste in motions of the wearer and make the motions appear beautiful.

Second Embodiment

Figure 5:
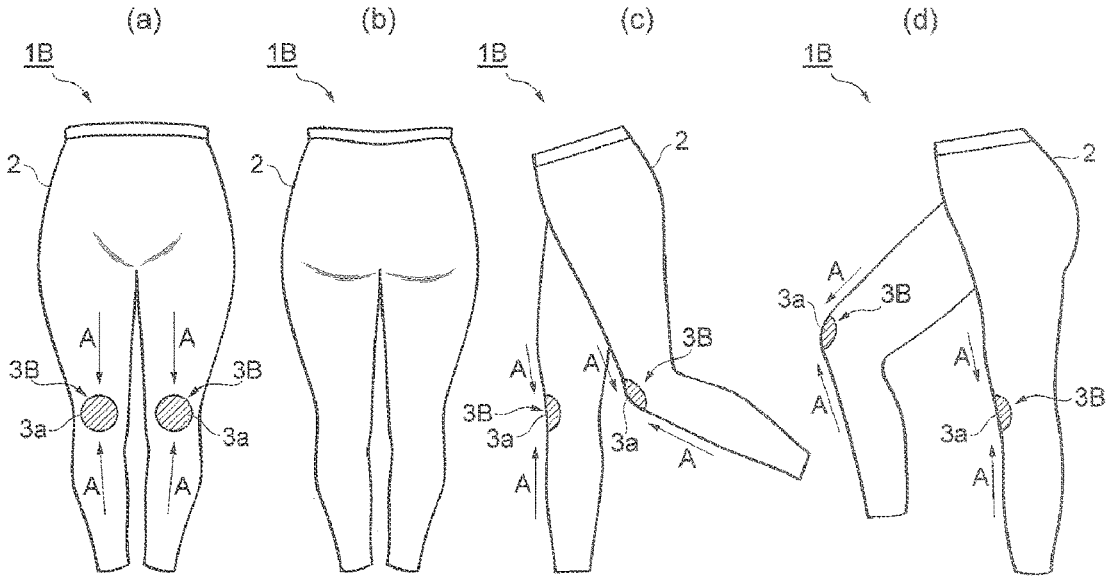
FIG. 5 is a set of diagrams illustrating how the lower-body garment in accordance with a second embodiment of the present invention is worn.

FIG. 5 is a set of diagrams illustrating how the lower-body garment in accordance with the second embodiment of the present invention is worn. The depicted lower-body garment 1B differs from the first embodiment in that it is of a type (A type) exhibiting only the above-mentioned effect A. That is, the lower-body garment 1B is provided with substantially circular expansion/contraction start parts 3B at positions overlapping the knee parts of the wearer on the front side of the main part 2.

In each expansion/contraction start part 3B, the whole part located so as to overlap the knee part of the wearer on the front side of the main part 2 is a first start part 3*a* which gathers the skin about the knee part toward the knee part while extending the skin about, the crotch part toward the knee part on the front side of the wearer.

In thus constructed lower-body garment 1B, the first start part 3*a* can act so as to enable the hip and knee joints to move smoothly and restrain the body of the wearer from jumping up. This can suppress waste in motions of the wearer and make the motions appear beautiful.

Third Embodiment

Figure 6:
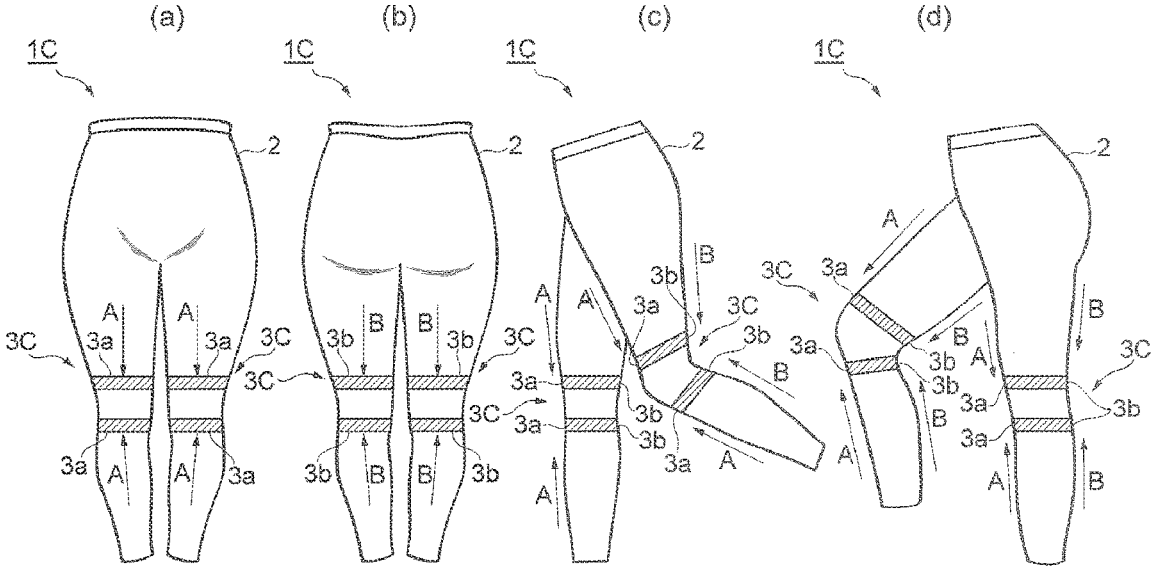
FIG. 6 is a set of diagrams illustrating how the lower-body garment in accordance with a third embodiment of the present invention is worn.

FIG. 6 is a set of diagrams illustrating how the lower-body garment in accordance with the third embodiment of the present invention is worn. The depicted lower-body garment 1C differs from the first embodiment in that it is of a type (AB type) exhibiting the above-mentioned effects A and B. That is, the lower-body garment 1C is provided with annular expansion/contraction start parts 3C located about the knee parts of the wearer thereabove and thereunder and separated from each other.

In the annular parts of the expansion/contraction start parts 3C, portions located on the front side of the main part 2 are first start parts 3*a* which circumferentially traverse the main part 2 above and under the portions covering the knee joints of the wearer on the front side of the main part 2 and gather the skin about the knee parts toward the knee parts while extending the skin about the crotch part toward the knee parts on the front side of the wearer. In the annular parts, portions located on the back side of the main part 2 are second start parts 3*b* which circumferentially traverse the main part 2 above and under the portions covering the knee joints of the wearer on the front side of the main part 2 and gather the skin about the knee parts toward the knee parts while extending the skin about the crotch part toward the knee parts on the back side of the wearer.

In thus constructed lower-body garment 1C, the first and second start parts 3*a*, 3*b* can act so as to enable the hip and knee joints to move smoothly and restrain the body of the Wearer from jumping up. This can suppress waste in motions of the wearer and make the motions appear beautiful.

Fourth Embodiment

Figure 7:
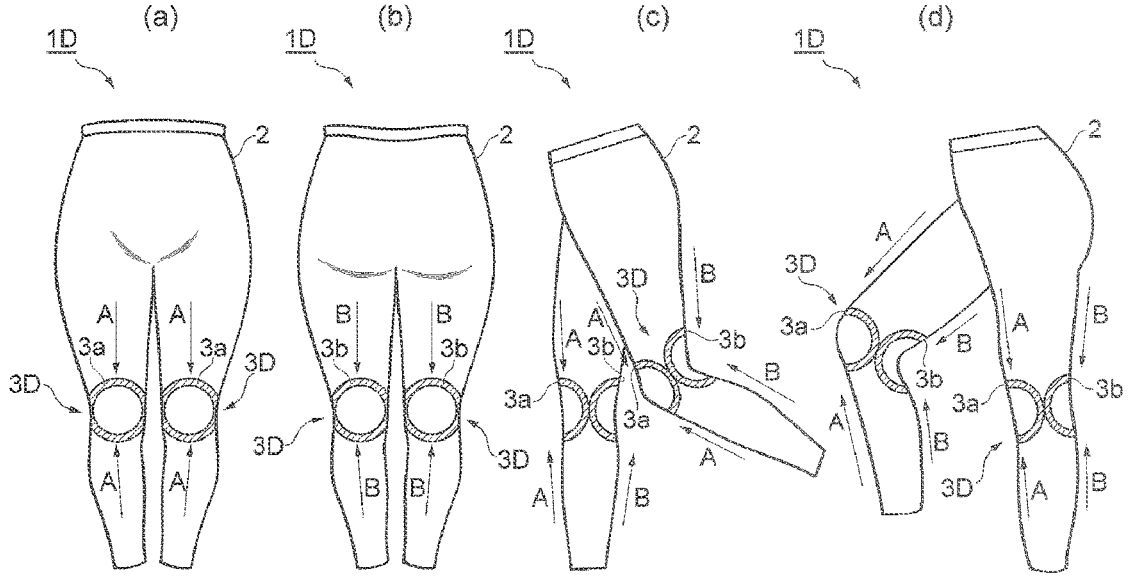
FIG. 7 is a set of diagrams illustrating how the lower-body garment in accordance with a fourth embodiment of the present invention is worn.

FIG. 7 is a set of diagrams illustrating how the lower-body garment in accordance with the fourth embodiment of the present invention is worn. The depicted lower-body garment 1D is a modified example of the type (AB type) exhibiting the above-mentioned effects A and B. This lower-body garment 1D is provided with an annular expansion/contraction start part 3D at such a position as to surround a knee joint of the wearer on each of the front and back sides of the main part 2. The annular rings on the front and back sides are joined to each other on the outer and inner side face sides of the main part 2.

In the annular parts of the expansion/contraction start parts 3D, portions located on the front side of the main part 2 are first start parts 3*a* which gather the skin about the knee parts toward the knee parts while extending the skin about the crotch part toward the knee parts on the front side of the wearer, and portions located on the back side of the main part 2 are second start parts 3*b* which gather the skin about the knee parts toward the knee parts while extending the skin about the crotch part toward the knee parts on the back side of the wearer.

In thus constructed lower-body garment 1D, the first and second start parts 3*a*, 3*b* can act so as to enable the hip and knee joints to move smoothly and restrain the body of the wearer from jumping up. This can suppress waste in motions of the wearer and make the motions appear beautiful.

Fifth Embodiment

Figure 8:
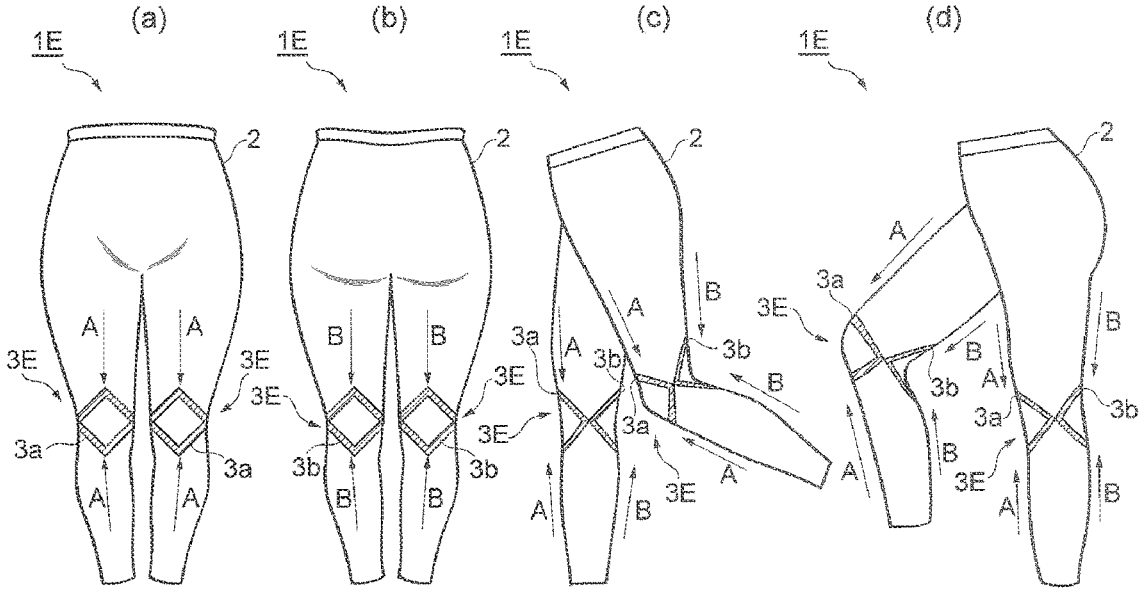
FIG. 8 is a set of diagrams illustrating how the lower-body garment in accordance with a fifth embodiment of the present invention is worn.

FIG. 8 is a set of diagrams illustrating how the lower-body garment in accordance with the fifth embodiment of the present invention is worn. The depicted lower-body garment 1E is another modified example of the type (AB type) exhibiting the above-mentioned effects A and B. This lower-body garment 1E is provided with a rhombic expansion/contraction start part 3E at such a position as to surround a knee joint of the wearer on each of the front and hack sides of the main part 2. The rhomboids on the front and back sides are joined to each other on the outer and inner side face sides of the main part 2.

In the rhombic parts of the expansion/contraction start parts 3E, the portions located on the front side of the main part 2 are first start parts 3*a* which gather the skin about the knee parts toward the knee parts while extending the skin about the crotch part toward the knee parts on the front side of the wearer, and the portions located on the back side of the main part 2 are second start parts 3*b* which gather the skin about the knee parts toward the knee parts while extending the skin about the crotch part toward the knee parts on the back side of the wearer.

In thus constructed lower-body garment. 1E, the first and second start parts 3*a*, 3*b* can act so as to enable the hip and knee joints to move smoothly and restrain the body of the wearer from jumping up. This can suppress waste hi motions of the wearer and make the motions appear beautiful.

Sixth Embodiment

Figure 9:
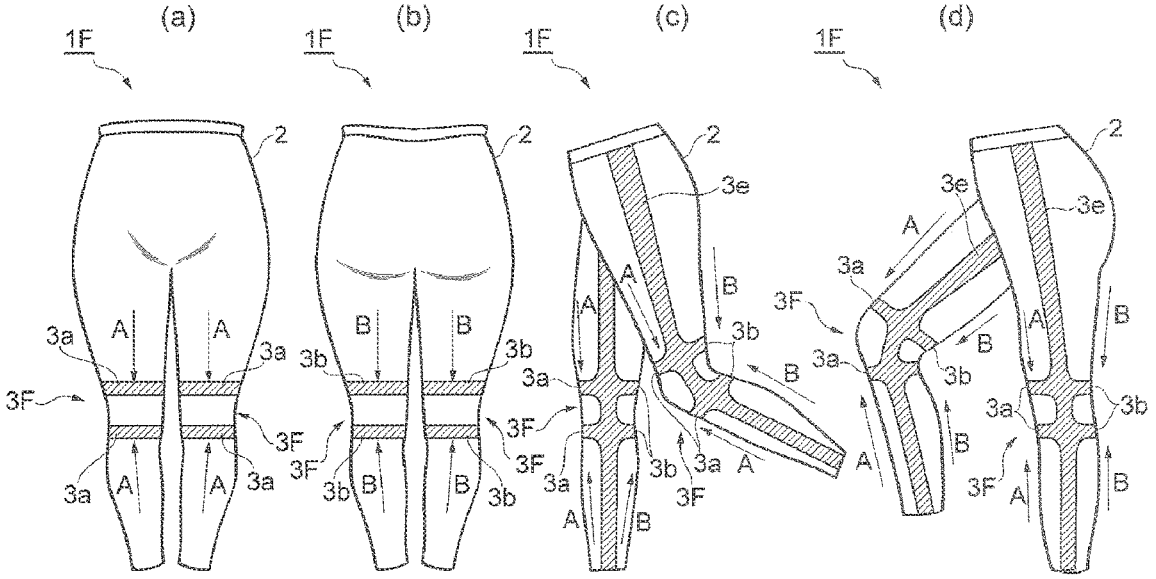
FIG. 9 is a set of diagrams illustrating how the lower-body garment in accordance with a sixth embodiment of the present invention is worn.

FIG. 9 is a set of diagrams illustrating how the lower-body garment in accordance with the sixth embodiment of the present invention is worn. The depicted lower-body garment 1F is still another modified example of the type (AB type) exhibiting the above-mentioned effects A and B. This lower-body garment 1F is provided with expansion/contraction start parts 3F constituted by annular parts formed about the knee parts of the wearer thereabove and thereunder as in the third embodiment and linear parts linearly extending from the crotch side of the wearer to the ankle side thereof on the outer and inner side face sides of the main part 2.

In the annular parts of the expansion/contraction start parts 3F, portions located on the front side of the main part 2 are first start parts 3*a* which circumferentially traverse the main part 2 above and under the portions covering the knee joints of the wearer on the front side of the main part 2 and gather the skin about the knee parts toward the knee parts while extending the skin about the crotch part toward the knee parts on the front side of the wearer. In the annular parts, portions located on the back side of the main part 2 are second start parts 3*b* which circumferentially traverse the main part 2 above and under the portions covering the knee joints of the wearer on the front side of the main part 2 and gather the skin about the knee parts toward the knee parts while extending the skin about the crotch part toward the knee parts on the back side of the wearer.

In thus constructed lower-body garment 1F, the first and second start parts 3*a*, 3*b* can act so as to enable the hip and knee joints to move smoothly and restrain the body of the wearer from jumping up. This can suppress waste in motions of the wearer and make the motions appear beautiful.

The portions 3*e* linearly extending from the crotch side to the ankle side on the outer and inner side face sides of the main part 2 are effective in stabilizing the legs of the wearer, which differs from the effects of the present invention. As in this embodiment, the expansion/contraction start part may further be formed with portions having different purposes to such an extent that the above-mentioned effects A to D are not inhibited thereby.

Seventh Embodiment

Figure 10:
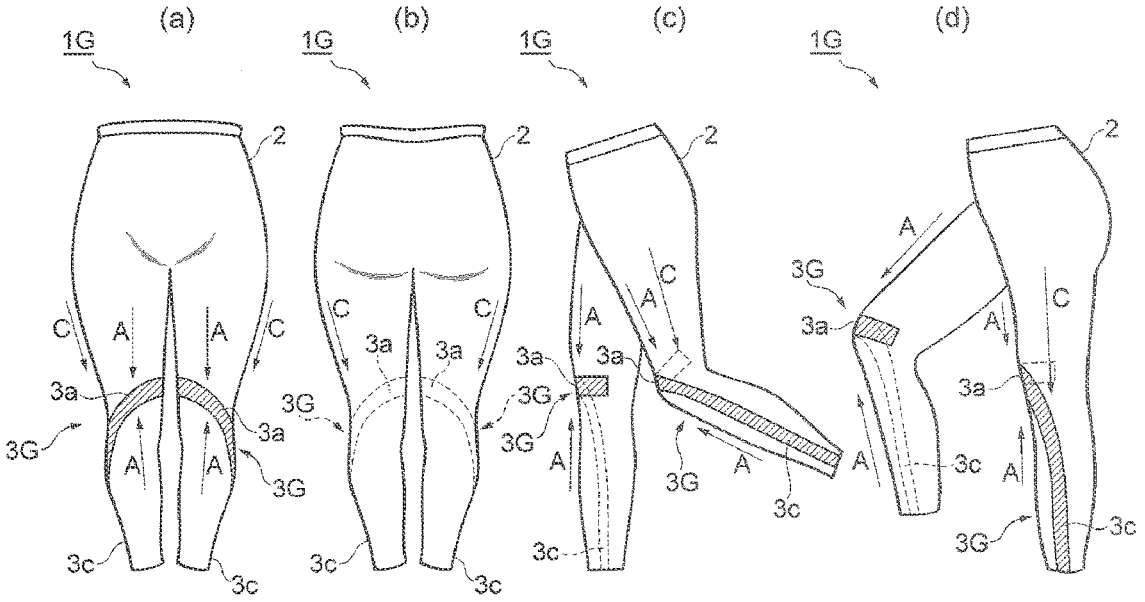
FIG. 10 is a set of diagrams illustrating how the lower-body garment in accordance with a seventh embodiment of the present invention is worn.

FIG. 10 is a set of diagrams illustrating how the lower-body garment in accordance with the seventh embodiment of the present invention is worn. The depicted lower-body garment 1G differs from the first embodiment in that it is of a type (AC type) exhibiting the above-mentioned effects A and C. This lower-body garment 1G is provided with linear expansion/contraction start parts 3G each of which travels obliquely above a knee part on the front side of the main part 2, turns to the outer side face side of the main part 2, and extends to an ankle part of the wearer.

In each expansion/contraction start part 3G, a portion located above the knee part on the front side of the main part 2 is a first start part 3*a* which separates the main part 2 into a portion covering the knee joint of the wearer and a portion covering the femoral part of the wearer and gathers the skin about the knee part toward the knee part while extending the skin about the crotch part toward the knee part A portion located above the ankle part on the outer side face side of the main part 2 is a third start part 3*c* which extends the skin about the greater trochanter toward the femoral part.

In thus constructed lower-body garment 1G; the first start part 3*a* can act so as to enable the hip and knee joints to move smoothly and restrain the body of the wearer from jumping up. The third start part 3*c* can act so as to stabilize the motions of the hip joints of the wearer and restrain the hips from flowing laterally outward from the body. These can suppress waste in motions of the wearer and make the motions appear beautiful.

Eighth Embodiment

Figure 11:
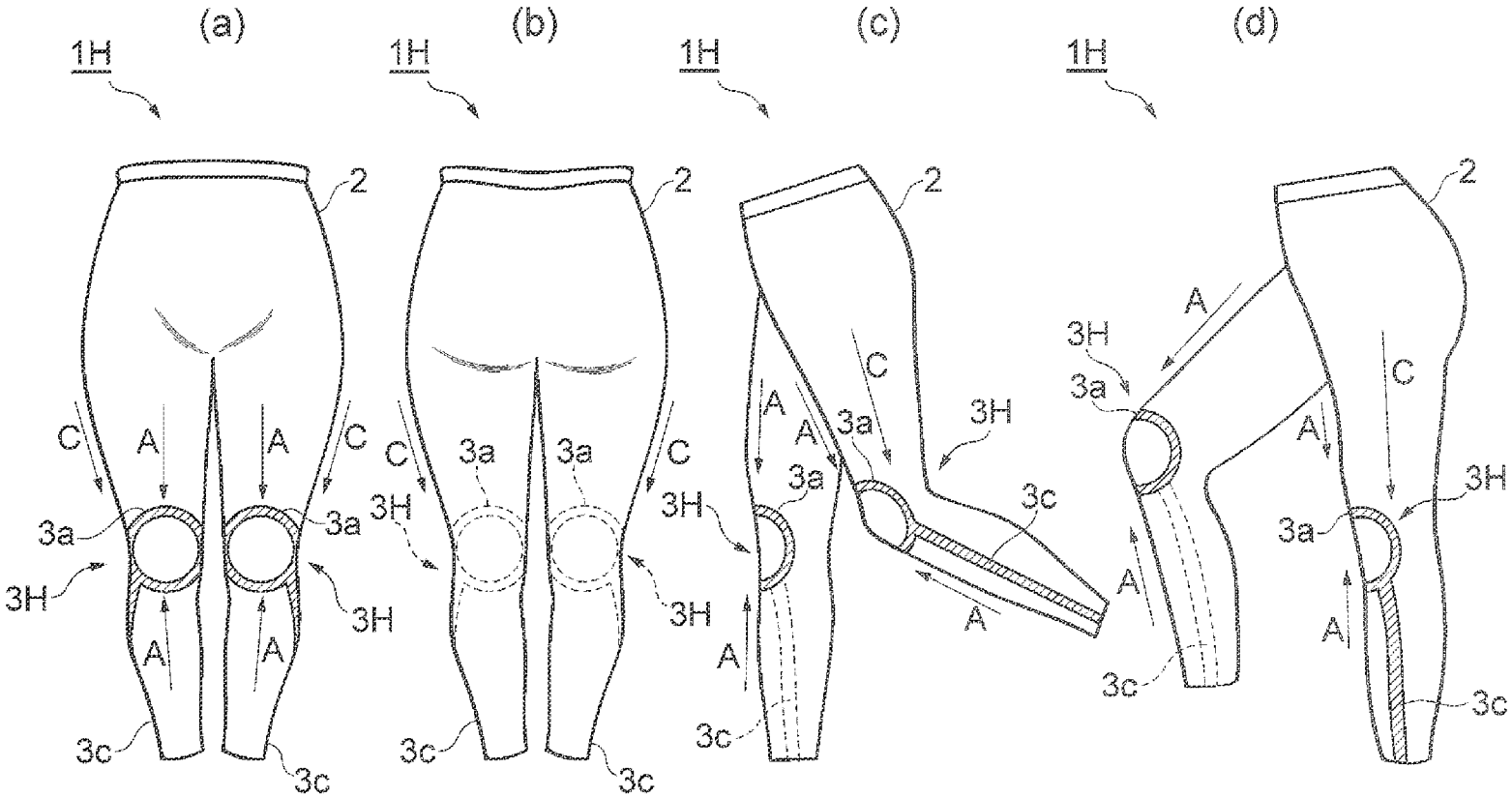
FIG. 11 is a set of diagrams illustrating how the lower-body garment in accordance with an eighth embodiment of the present invention is worn.

FIG. 11 is a set of diagrams illustrating how the lower-body garment in accordance with the eighth embodiment of the present invention is worn. The depicted lower-body garment 1H is a modified example of the type (AC type) exhibiting the above-mentioned effects A and C. This lower-body garment in is provided with expansion/contraction start parts 3H each constituted by an annular part formed at such a position as to surround a knee joint of the wearer on the front side of the main part 2 and a part, joined to the annular part, extending to an ankle part of the wearer on the outer side face side of the main part 2.

In each expansion/contraction start part 3H, a portion located on the front side of the main part 2 in the annular part is a first start part 3*a* which gathers the skin about a knee part toward the knee part while extending the skin about the crotch part toward the knee part on the front side of the wearer, and a portion located above the ankle part on the outer side face side of the main part 2 is a third start part 3*c* which extends the skin about the greater trochanter toward the femoral part.

In thus constructed lower-body garment 1H, the first start part 3*a* can act so as to enable the hip and knee joints to move smoothly and restrain the body of the wearer from jumping up. The third start part 3*c* can act so as to stabilize the motions of the hip joints of the wearer and restrain the hips from flowing laterally outward from the body. These can suppress waste in motions of the wearer and make the motions appear beautiful.

Ninth Embodiment

Figure 12:
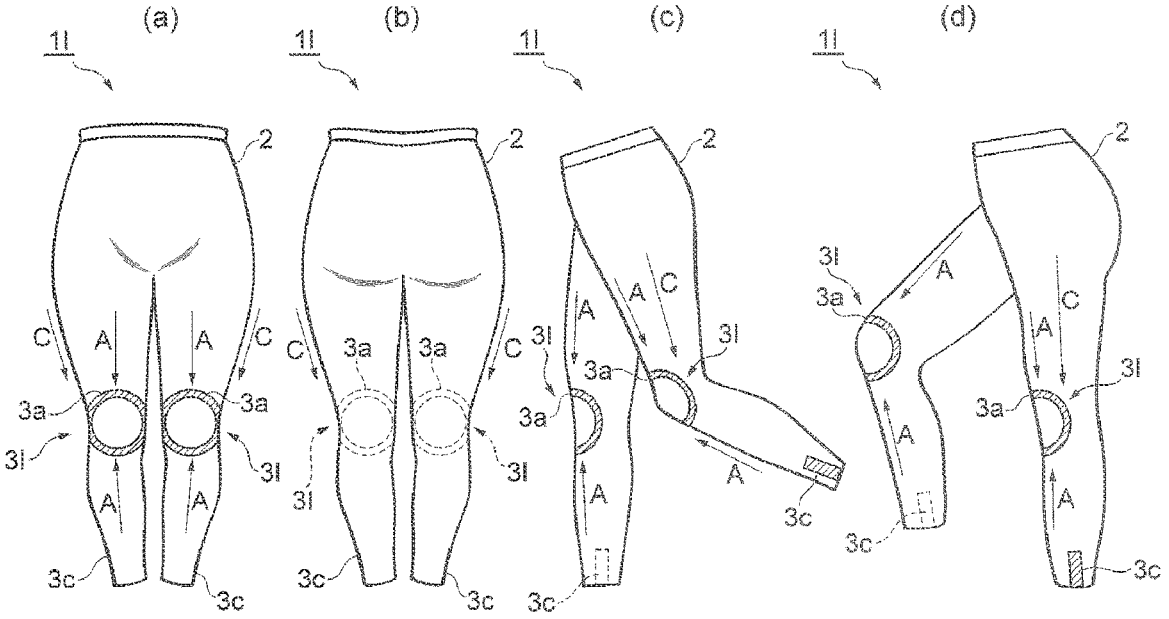
FIG. 12 is a set of diagrams illustrating how the lower-body garment in accordance with a ninth embodiment of the present invention is worn.

FIG. 12 is a set of diagrams illustrating how the lower-body garment in accordance with the seventh embodiment of the present invention is worn. The depicted lower-body garment 1I is another modified example of the type (AC type) exhibiting the above-mentioned effects A and C. This lower-body garment 1I is provided with expansion/contraction start parts 3I each constituted by an annular part formed at such a position as to surround a knee joint of the wearer on the front side of the main part 2 and a part, separated from the annular part, extending only near an ankle part of the wearer on the outer side face side of the main part 2.

In each expansion/contraction start part 3I, a portion located on the front side of the main part 2 in the annular part is a first start part 3*a* which gathers the skin about a knee part toward the knee part while extending the skin about the crotch part toward the knee part on the front side of the wearer, and a portion located near the ankle part on the outer side face side of the main part 2 is a third start part 3*c* which extends the skin about the greater trochanter toward the femoral part.

In thus constructed lower-body garment 1I, the first start part 3*a* can act so as to enable the hip and knee joints to move smoothly and restrain the body of the wearer from jumping up. The third start part 3*c* can act so as to stabilize the motions of the hip joints of the wearer and restrain the hips from flowing laterally outward from the body. These can suppress waste in motions of the wearer and make the motions appear beautiful.

Tenth Embodiment

Figure 13:
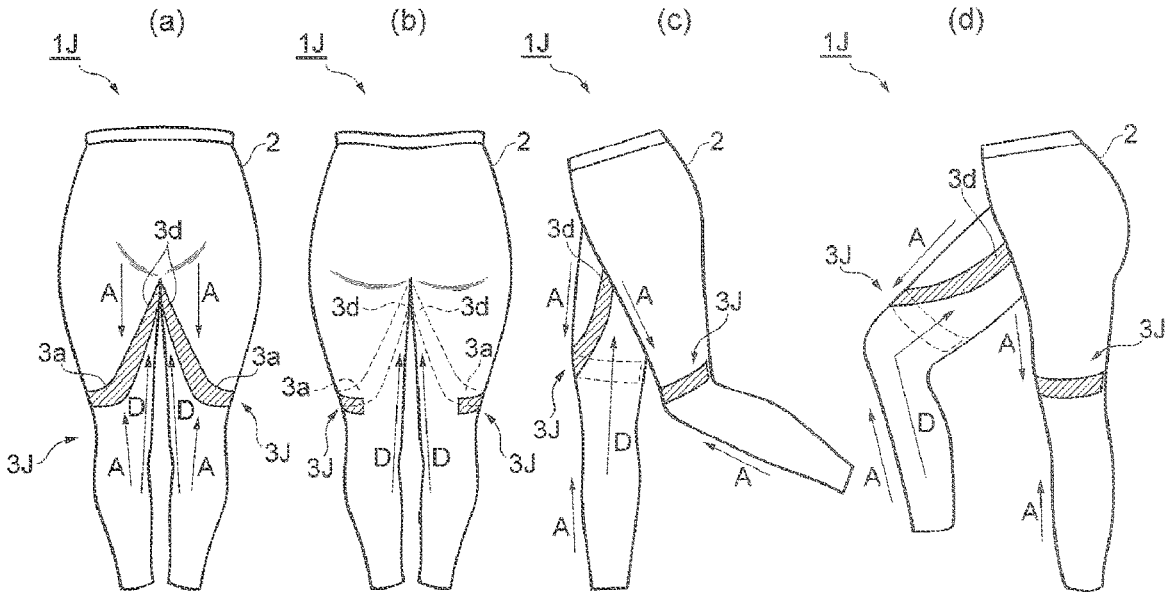
FIG. 13 is a set of diagrams illustrating how the lower-body garment in accordance with a tenth embodiment of the present invention is worn.

FIG. 13 is a set of diagrams illustrating how the lower-body garment in accordance with the tenth embodiment of the present invention is worn. The depicted lower-body garment 1J differs from the first embodiment in that it is of a type (AD type) exhibiting the above-mentioned effects A and D. This lower-body garment 1J is provided with linear expansion/contraction start parts 3I each of which travels obliquely above a knee part on the front side of the main part 2, turns to the inner side face side of the main part 2, and extends to the crotch part of the wearer.

In each expansion/contraction start part 3J, a portion located above the knee part on the front side of the main part 2 is a first start part 3*a* which separates the main part 2 into a portion covering the knee joint of the wearer and a portion covering the femoral part of the wearer and gathers the skin about the knee part toward the knee part while extending the skin about the crotch part toward the knee part on the front side of the wearer. A portion located near the crutch part on the inner side face side of the main part 2 is a fourth start part 3*d* which gathers the skin on the inner side face side of a leg of the wearer toward the crotch part.

In thus constructed lower-body garment 1J, the first start part 3*a* can act so as to enable the hip and knee joints to move smoothly and restrain the body of the wearer from jumping up. The fourth start part 3*d* can act so as to stabilize the motions of the hip joints of the wearer and restrain the hips from flowing laterally outward from the body. These can suppress waste in motions of the wearer and make the motions appear beautiful.

Eleventh Embodiment

Figure 14:
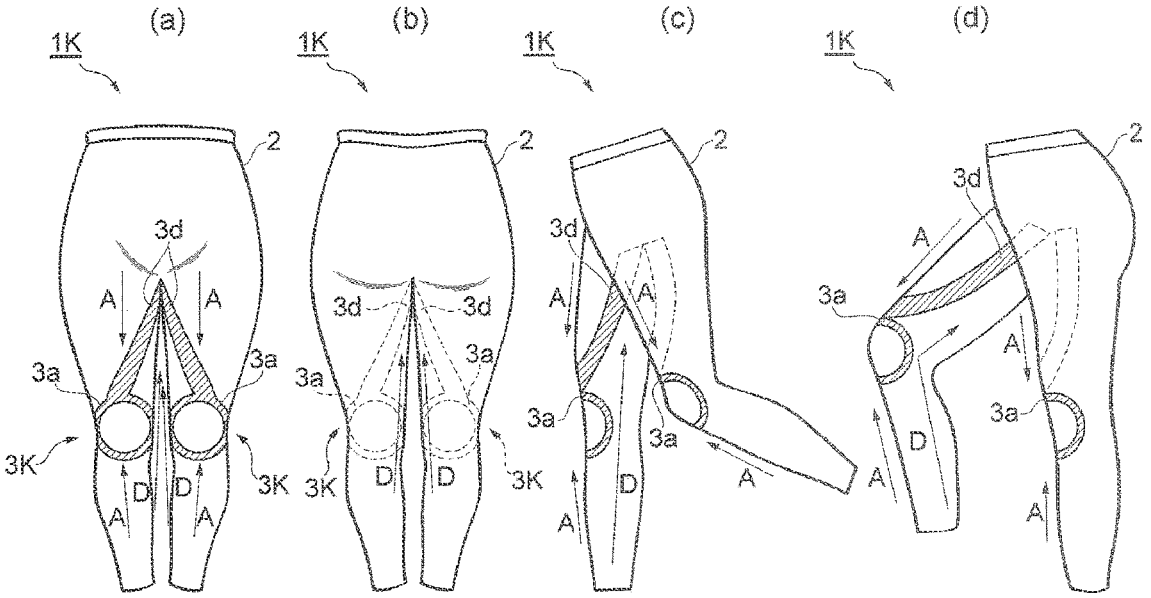
FIG. 14 is a set of diagrams illustrating how the lower-body garment in accordance with an eleventh embodiment of the present invention is worn.

FIG. 14 is a set of diagrams illustrating how the lower-body garment in accordance with the eleventh embodiment of the present invention is worn. The depicted lower-body garment 1K is a modified example of the type (AD type) exhibiting the above-mentioned effects A and D. This lower-body garment 1K is provided with expansion/contraction start parts 3K each constituted by an annular part formed at such a position as to surround a knee joint of the wearer on the front side of the main part 2 and a part, joined to the annular part, extending to the crotch part of the wearer on the inner side face side of the main part 2.

In each expansion/contraction start part 3K, a portion located on the front side of the main part 2 in the annular part is a first start part 3*a* which gathers the skin about the knee part toward the knee part while extending the skin about the crotch part toward the knee part on the front side of the wearer, and a portion located near the crotch part on the inner side face side of the main part 2 is a fourth start part 3*d* which gathers the skin on the inner side face side of a leg of the wearer toward the crotch part.

In thus constructed lower-body garment 1K, the first start part 3*a* can act so as to enable the hip and knee joints to move smoothly and restrain the body of the wearer from jumping up. The fourth start part 3*d* can act so as to stabilize the motions of the hip joints of the wearer and restrain the hips from flowing laterally outward from the body. These can suppress waste in motions of the wearer and make the motions appear beautiful.

Twelfth Embodiment

Figure 15:
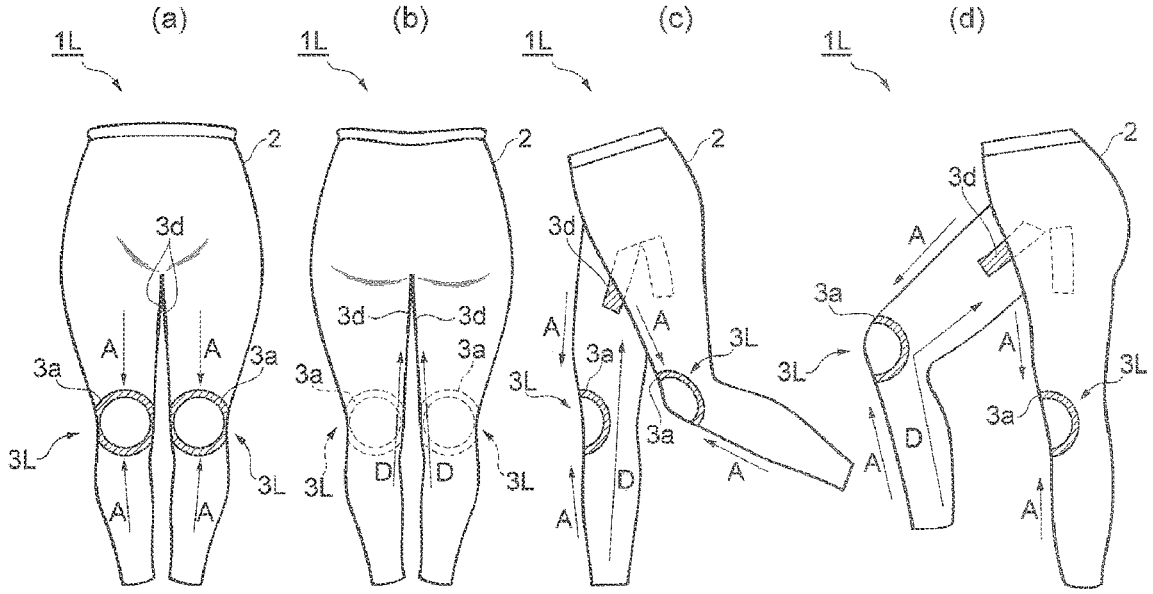
FIG. 15 is a set of diagrams illustrating how the lower-body garment in accordance with a twelfth embodiment of the present invention is worn.

FIG. 15 is a set of diagrams illustrating how the lower-body garment in accordance with the twelfth embodiment of the present invention is worn. The depicted lower-body garment 1L is another modified example of the type (AD type) exhibiting the above-mentioned effects A and D. This lower-body garment 1L is provided with expansion/contraction start parts 3L each constituted by an annular part formed at such a position as to surround a knee joint of the wearer on the front side of the main part 2 and a part, separated from the annular part, extending near the crotch part of the wearer on the inner side face side of the main part 2.

In each expansion/contraction start part 3L, a portion located on the front side of the main part 2 in the annular part is a first start part 3*a* which gathers the skin about the knee part toward the knee part while extending the skin about the crotch part toward the knee part on the front side of the wearer, and a portion located near the crotch part on the inner side face side of the main part 2 is a fourth start part 3*d* which gathers the skin on the inner side face side of a leg of the wearer toward the crotch part.

In thus constructed lower-body garment 1L, the first start part 3*a* can act so as to enable the hip and knee joints to move smoothly and restrain the body of the wearer from jumping up. The fourth start part 3*d* can act so as to stabilize the motions of the hip joints of the wearer and restrain the hips from flowing laterally outward from the body. These can suppress waste in motions of the wearer and make the motions appear beautiful.

Thirteenth Embodiment

Figure 16:
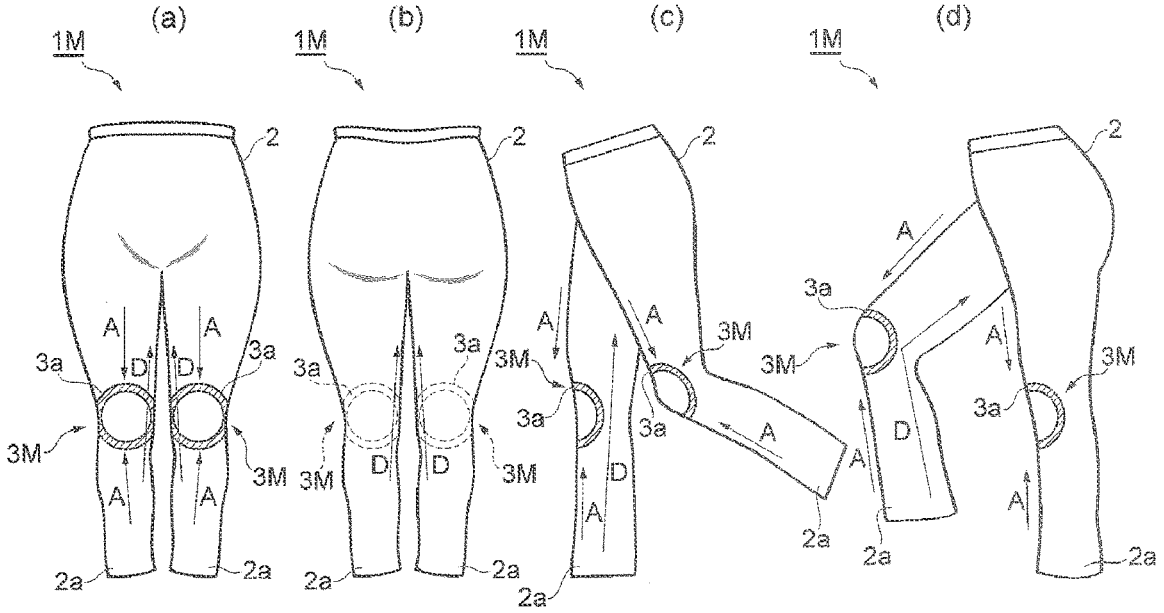
FIG. 16 is a set of diagrams illustrating how the lower-body garment in accordance with a thirteenth embodiment of the present invention is worn.

FIG. 16 is a set of diagrams illustrating how the lower-body garment in accordance with the thirteenth embodiment of the present invention is worn. The depicted lower-body garment 1M is still another modified example of the type (AD type) exhibiting the above-mentioned effects A and D. This lower-body garment 1M is provided with annular expansion/contraction start parts 3M at positions surrounding knee joints of the wearer. In the main part 2, the diameters of bottom parts 2*a* are increased to such an extent that they do not float about the ankle parts i.e., they do not ride up).

In the annular part of each expansion/contraction start part 3M, a portion located on the front side of the main part 2 is a first start part 3*a* which gathers the skin about the knee part toward the knee part while extending the skin about the crotch part toward the knee part on the front side of the wearer.

In thus constructed lower-body garment 1M, the first start part 3*a* can act so as to enable the hip and knee joints to move smoothly and restrain the body of the wearer from jumping up. Since the bottom parts 2*a* of the main part 2 have larger diameters, the degree of adherence near the crotch part on the inner side face side of the main part 2 is higher than that near the ankle parts, thus becoming effective in gathering the skin on the inner side face side of the wearer toward the crotch part. This can stabilize the motions of the hip joints of the wearer and restrain the hips from flowing laterally outward from the body. Therefore, waste in motions of the wearer can be suppressed, so as to make the motions appear beautiful.

Fourteenth Embodiment

Figure 17:
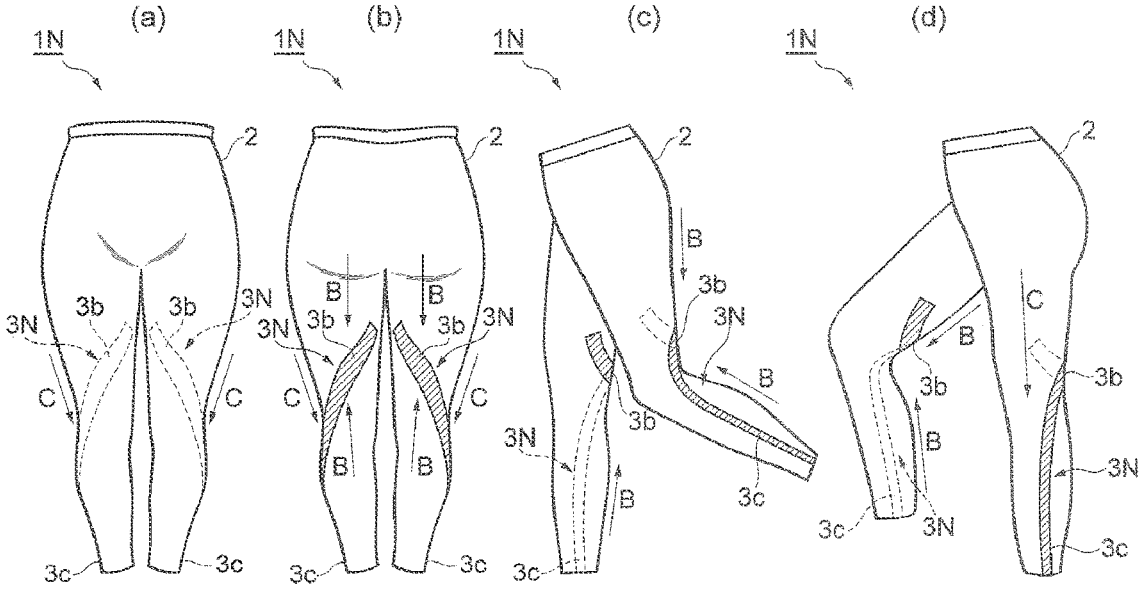
FIG. 17 is a set of diagrams illustrating how the lower-body garment in accordance with a fourteenth embodiment of the present invention is worn.

FIG. 17 is a set of diagrams illustrating how the lower-body garment in accordance with the fourteenth embodiment of the present invention is worn. The depicted lower-body garment 1N differs from the first embodiment in that it is of a type (BC type) exhibiting the above-mentioned effects B and C. This lower-body garment 1N is provided with linear expansion/contraction start parts 3N each of which travels obliquely above a knee part on the back side of the main part 2, turns to the outer side face side of the main part 2, and extends to an ankle part of the wearer.

In each expansion/contraction start part 3N a portion located above the knee part on the back side of the main part 2 is a second start part 3*b* which separates the main part 2 into a portion covering the knee joint of the wearer and a portion covering the femoral part of the wearer and gathers the skin about the knee part toward the knee part while extending the skin about the crotch part toward the knee part on the front side of the wearer. A portion located near the ankle part on the outer side face side of the main part 2 is a third start part 3*c* which gathers the skin about the greater trochanter toward the femoral part on the outer side face side of the wearer.

In thus constructed lower-body garment 1N, the second start part 3*b* can act so as to enable the hip and knee joints to move smoothly and restrain the body of the wearer from jumping up. The third start part 3*c* can act so as to stabilize the motions of the hip joints of the wearer and restrain the hips from flowing laterally outward from the body. These can suppress waste in motions of the wearer and make the motions appear beautiful.

Fifteenth Embodiment

Figure 18:
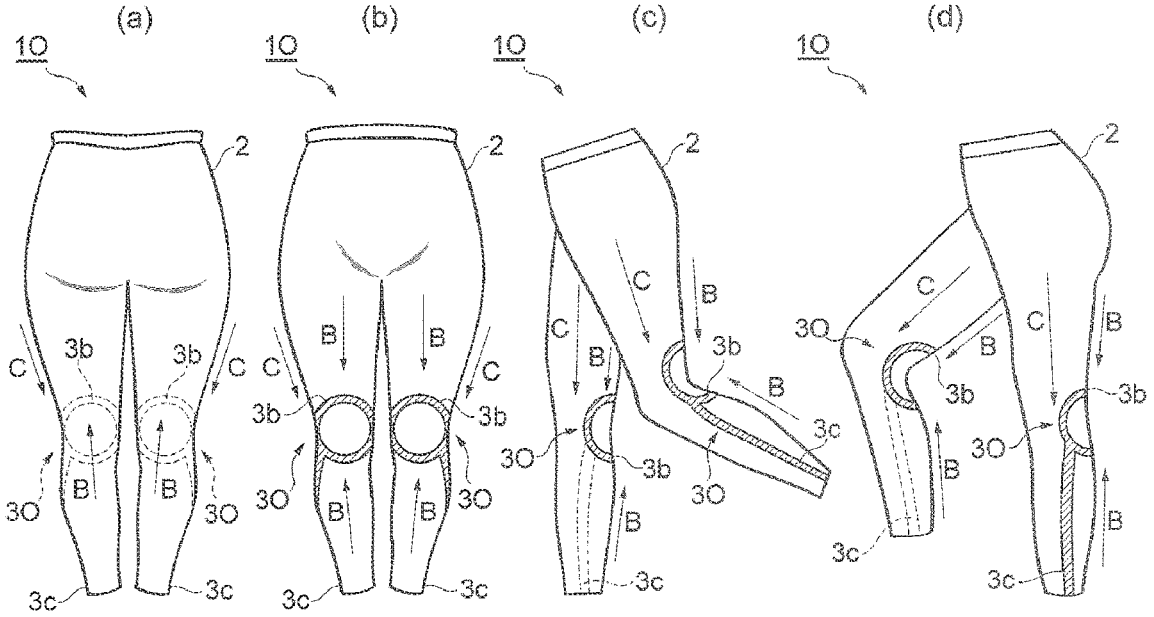
FIG. 18 is a set of diagrams illustrating how the lower-body garment in accordance with a fifteenth embodiment of the present invention is worn.

FIG. 18 is a set of diagrams illustrating how the lower-body garment in accordance with the fifteenth embodiment of the present invention is worn. The depicted lower-body garment 1O is a modified example of the type (BC type)

exhibiting the above-mentioned effects B and C. This lower-body garment 1O is provided with expansion/contraction start parts 3O each constituted by an annular part formed at such a position as to surround a knee joint of the wearer on the back side of the main part 2 and a part, joined, to the annular part, extending to an ankle part of the wearer on the outer side face side of the main part 2.

In each expansion/contraction start part 3O, a portion located on the hack side of the main part 2 in the annular part is a second start part 3*b* which gathers the skin about the knee part toward the knee part while extending the skin about the crotch part toward the knee part on the back side of the wearer, and a portion located near the ankle part on the outer side face side of the main part 2 is a third start part 3*c* which gathers the skin about the greater trochanter of the wearer toward the femoral part.

In thus constructed lower-body garment 1O, the second start part 3*b* can act so as to enable the hip and knee joints to move smoothly and restrain the body of the wearer from jumping up. The third start part 3*c* can act so as to stabilize the motions of the hip joints of the wearer and restrain the hips from flowing laterally outward from the body. These can suppress waste in motions of the wearer and make the motions appear beautiful.

Sixteenth Embodiment

Figure 19:
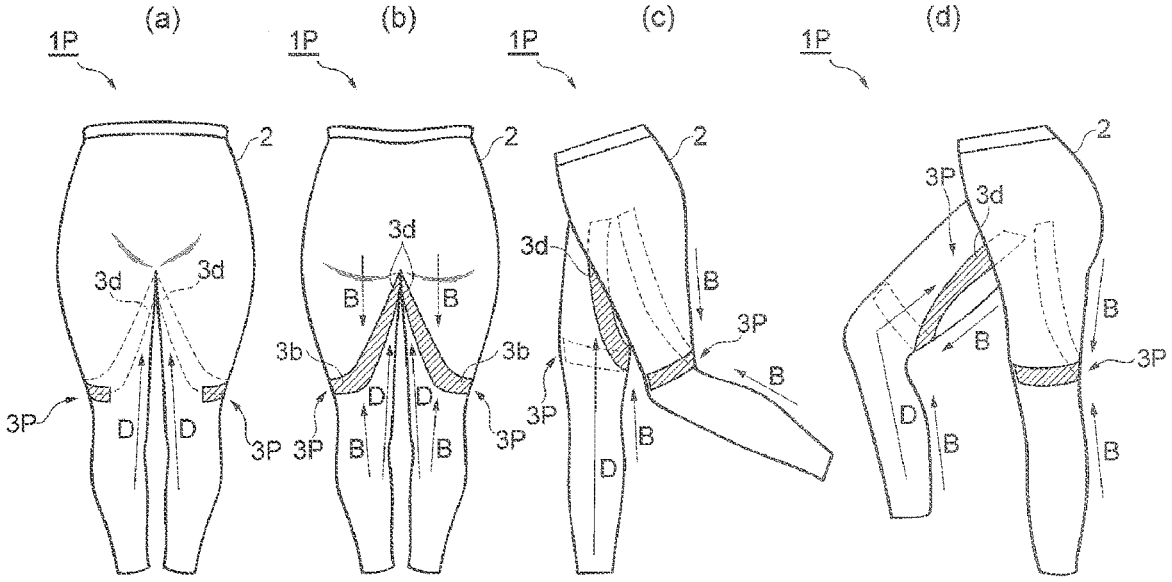
FIG. 19 is a set of diagrams illustrating how the lower-body garment in accordance with a sixteenth embodiment of the present invention is worn.

FIG. 19 is a set of diagrams illustrating how the lower-body garment in accordance with the sixteenth embodiment of the present invention is worn. The depicted lower-body garment 1P differs from the first embodiment in that it is of a type (BD type) exhibiting the above-mentioned effects B and I). This lower-body garment 1P is provided with linear expansion/contraction start parts 3P each of which travels obliquely above a knee part on the back side of the main part 2, turns to the inner side face side of the main part 2, and extends to the crotch part of the wearer.

In each expansion/contraction start part 3P, a portion located above the knee part on the back side of the main part 2 is a second start part 3*b* which separates the main part 2 into a portion covering the knee joint of the wearer and a portion covering the femoral part of the wearer and gathers the skin about the knee part toward the knee part while extending the skin about the crotch part toward the knee part on the back side of the wearer, and a portion located near the crotch part on the inner side face side of the main part 2 is a fourth start part 3*d* which gathers the skin on the inner side face side of a leg of the wearer toward the crotch part.

In thus constructed lower-body garment 1P, the second start part 3*b* can act so as to enable the hip and knee joints to move smoothly and restrain the body of the wearer from jumping up. The fourth start part 3*d* can act so as to stabilize the motions of the hip joints of the wearer and restrain the hips from flowing laterally outward from the body. These can suppress waste in motions of the wearer and make the motions appear beautiful.

Seventeenth Embodiment

Figure 20:
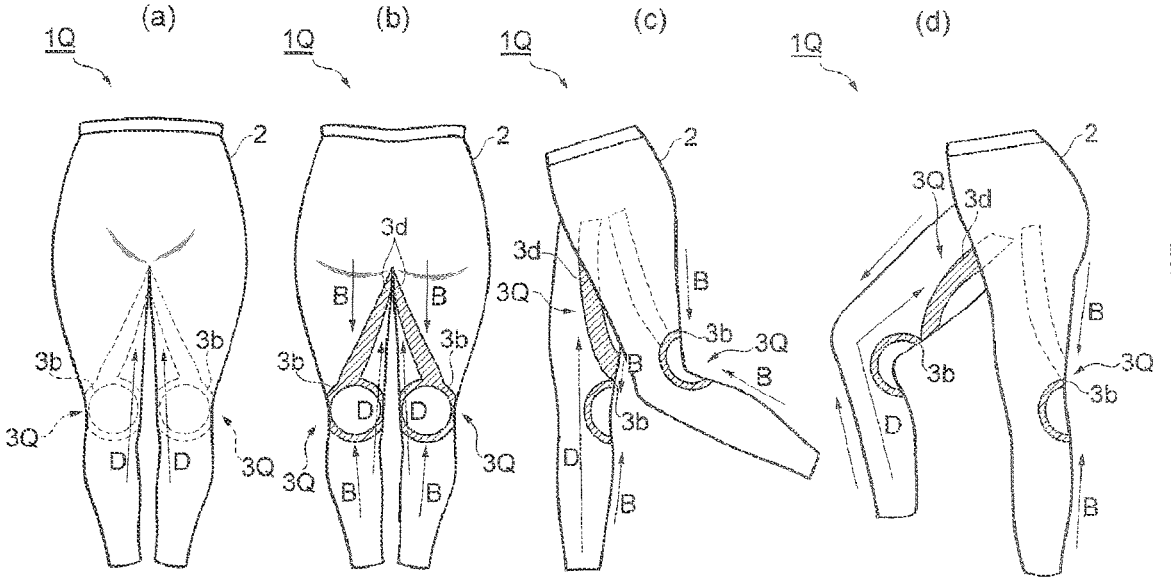
FIG. 20 is a set of diagrams illustrating how the lower-body garment in accordance with a seventeenth embodiment of the present invention is worn.

FIG. 20 is a set of diagrams illustrating how the lower-body garment in accordance with the seventeenth embodiment of the present invention is worn. The depicted lower-body garment 1Q is a modified example of the type (BD type) exhibiting the above-mentioned effects B and D. This lower-body garment 1Q is provided with expansion/contraction start parts 3Q each constituted by an annular part formed at such a position as to surround a knee joint of the wearer on the back side of the main part 2 and a part, joined to the annular part, extending to the crotch part of the wearer on the inner side face side of the main part 2.

In each expansion/contraction start part 3Q, a portion located on the back side of the main part 2 in the annular part is a second start part 3*b* which gathers the skin about the knee part toward the knee part while extending the skin about the crotch part toward the knee part on the back side of the wearer, and a portion located near the crotch part on the inner side face side of the main part 2 is a fourth start part 3*d* which gathers the skin on the inner side face side of a leg of the wearer toward the crotch part.

In thus constructed lower-body garment, the second start part 3*b* can act so as to enable the hip and knee joints to move smoothly and restrain the body of the wearer from jumping up. The fourth start part 3*d* can act so as to stabilize the motions of the hip joints of the wearer and restrain the hips from flowing laterally outward from the body. These can suppress waste in motions of the wearer and make the motions appear beautiful.

Eighteenth Embodiment

Figure 21:
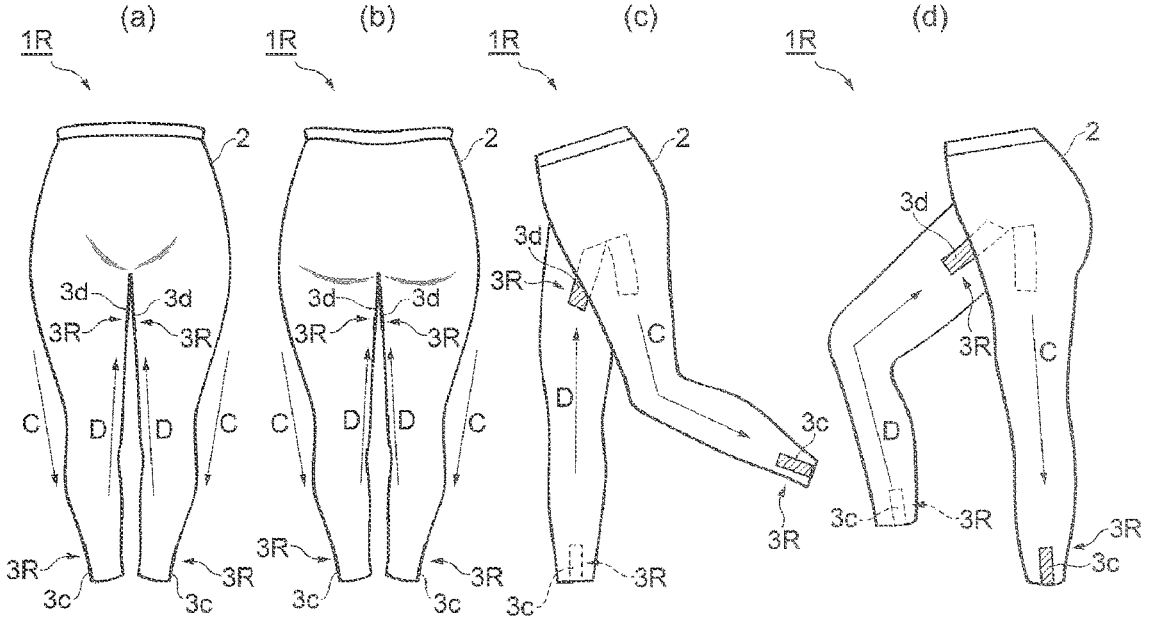
FIG. 21 is a set of diagrams illustrating how the lower-body garment in accordance with an eighteenth embodiment of the present invention is worn.

FIG. 21 is a set of diagrams illustrating how the lower-body garment in accordance with the eighteenth embodiment of the present invention is worn. The depicted lower-body garment 1R differs from the first embodiment in that it is of a type (CD type) exhibiting the above-mentioned effects C and D. This lower-body garment 1R is provided with linear expansion/contraction start parts 3R each constituted by a part extending near an ankle part of the wearer on the outer side face side of the main part and a part extending near the crotch part of the wearer on the inner side face side of the main part 2.

In each linear expansion/contraction start part 3R, a portion located near the ankle part of the wearer on the outer side face side of the main part 2 is a third start part 3*c* which extends the skin about the greater trochanter of the wearer toward the femoral part, and a portion located near the crotch part on the inner side face side of the main part 2 is a fourth start part 3*d* which gathers the skin on the inner side face side of a leg of the wearer toward the crotch part.

In thus constructed lower-body garment 1R, the third and fourth start parts 3*c*, 3*d* can act so as to stabilize the motions of the hip joints of the wearer and restrain the hips from flowing laterally outward from the body. This can suppress waste in motions of the wearer and make the motions appear beautiful.

Nineteenth Embodiment

Figure 22:
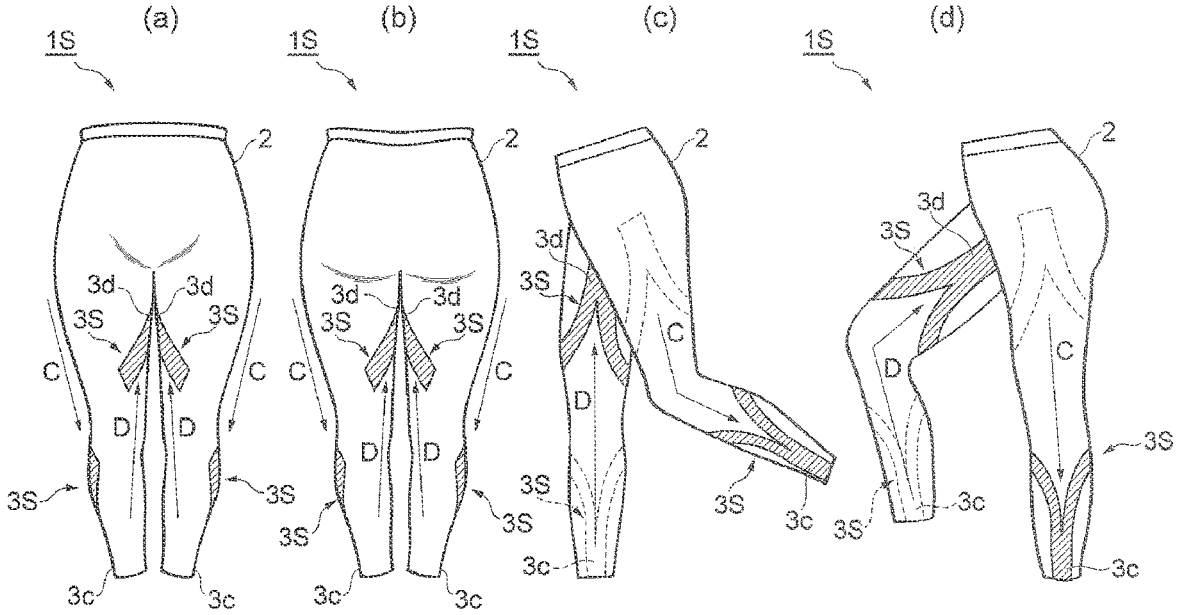
FIG. 22 is a set of diagrams illustrating how the lower-body garment in accordance with a nineteenth embodiment of the present invention is worn.

FIG. 22 is a set of diagrams illustrating how the lower-body garment in accordance with the nineteenth embodiment of the present invention is worn. The depicted lower-body garment 1S is a modified example of the type (CD type) exhibiting the above-mentioned effects C and D. This lower-body garment 1S is provided with expansion/contraction start parts 3S each constituted by a part extending near an ankle part of the wearer on the outer side face side of the main part 2 and branching into the front and back sides of the main part 2 on the upper side and a part extending near the crotch part of the wearer on the inner side face side of the main part 2 and branching into the front and back sides of the main part 2 on the lower side.

In each expansion/contraction start part 3S, a portion located near the ankle part of the wearer on the outer side face side of the main part 2 is a third start part 3*c* which extends the skin about the greater trochanter of the wearer toward the femoral part, and a portion located near the crotch part on the inner side face side of the main part 2 is a fourth start part 3*d* which gathers the skin on the inner side face side of a leg of the wearer toward the crotch part.

In thus constructed lower-body garment 15, the third and fourth start parts 3*c*, 3*d* can act so as to stabilize the motions of the hip joints of the wearer and restrain the hips from flowing laterally outward from the body. This can suppress waste in motions of the wearer and make the motions appear beautiful.

Twentieth Embodiment

Figure 23:
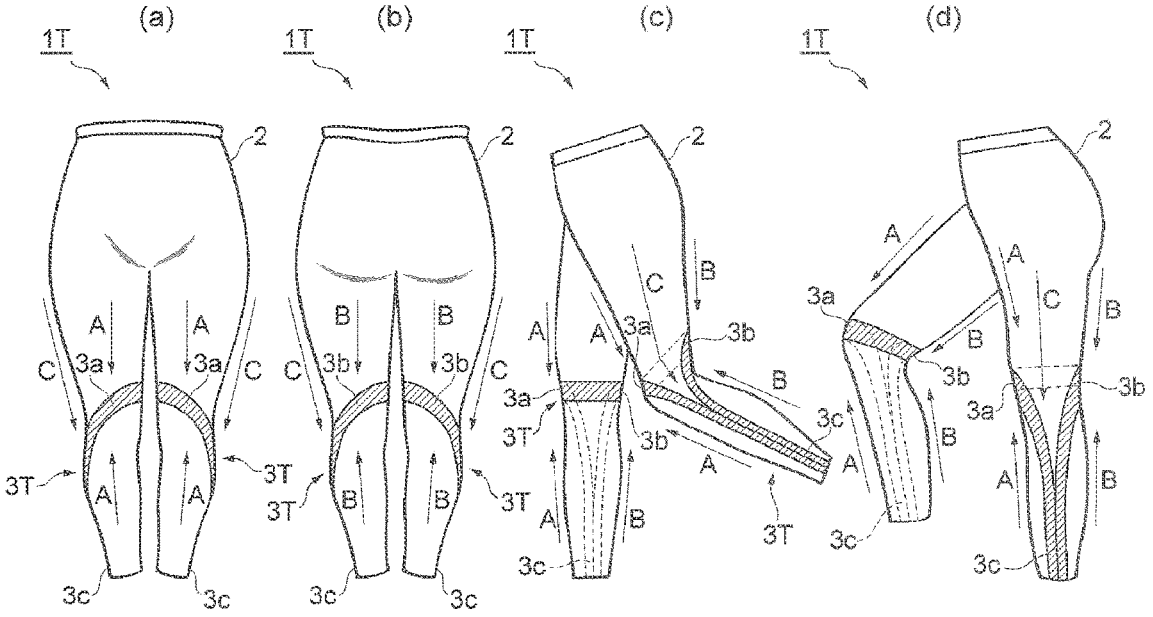
FIG. 23 is a set of diagrams illustrating how the lower-body garment in accordance with a twentieth embodiment of the present invention is worn.

FIG. 23 is a set of diagrams illustrating how the lower-body garment in accordance with the twentieth embodiment of the present invention is worn. The depicted lower-body garment 1T differs from the first embodiment in that it is of a type (ABC type) exhibiting the above-mentioned effects A, B, and C. This lower-body garment 1T is provided with linear expansion/contraction start parts 3T each, extending near an ankle part of the wearer on the outer side face side of the main part 2, travels about a knee part of the wearer thereabove, and reaches near the ankle part of the wearer again on the outer side face side of the main part 2.

In each expansion/contraction start part 3T, a portion located above the knee part on the front side of the main part 2 is a first start part 3*a* which separates the main part 2 into a portion covering the knee joint of the wearer and a portion covering the femoral part of the wearer and gathers the skin about the knee part toward the knee part while extending the skin about the crotch part toward the knee part on the front side of the wearer. A portion located above the knee part on the back side of the main part 2 is a second start part 3*b* which separates the main part 2 into a portion covering the knee joint of the wearer and a portion covering the femoral part of the wearer and gathers the skin about the gluteal fold toward the knee part on the back side of the wearer. A portion located near the ankle part of the wearer on the outer side face side of the main part 2 is a third start part 3*c* which extends the skin about the greater trochanter of the wearer toward the femoral part.

In thus constructed lower-body garment 1T, the first and second start parts 3*a*, 3*b* can act so as to enable the hip and knee joints to move smoothly and restrain the body of the wearer from jumping up. This can suppress waste in motions of the wearer and make the motions appear beautiful. The third start part 3*c* can act so as to stabilize the motions of the hip joints of the wearer and, restrain the hips from flowing laterally outward from the body. This can suppress waste in motions of the wearer and make the motions appear beautiful.

Twenty-First Embodiment

Figure 24:
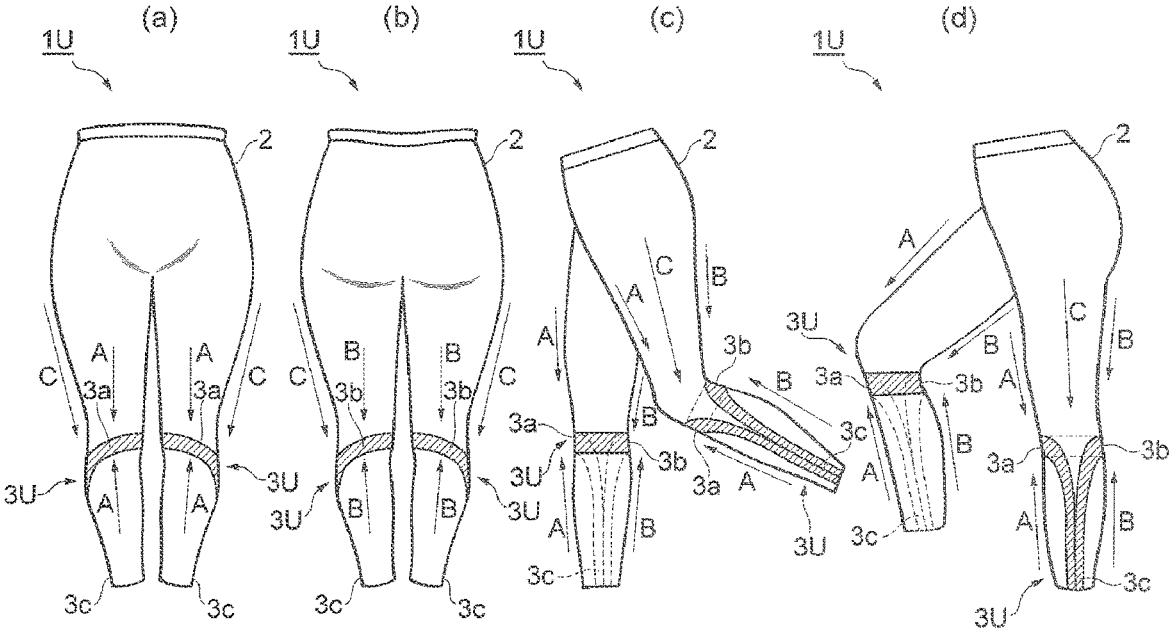
FIG. 24 is a set of diagrams illustrating how the lower-body garment in accordance with a twenty-first embodiment of the present invention is worn.

FIG. 24 is a set of diagrams illustrating how the lower-body garment in accordance with the twenty-first embodiment of the present invention is worn. The depicted lower-body garment 1U is a modified example of the type (ABC type) exhibiting the above-mentioned effects A, B, and C. This lower-body garment 1U is provided with linear expansion/contraction start parts 3U each extending near an ankle part of the wearer on the outer side face side of the main part 2, travels about a knee part of the wearer thereunder, and reaches near the ankle part of the wearer again on the outer side face side of the main part 2.

In each expansion/contraction start part 3U, a portion located under the knee part on the front side of the main part 2 is a first start part 3*a* which separates the main part 2 into a portion covering the knee joint of the wearer and a portion covering a shin part of the wearer and gathers the skin about the knee part toward the knee part while extending the skin about the crotch part toward the knee part on the front side of the wearer. A portion, located below the knee part on the back side of the main part 2 is a second start part 3*b* which separates the main part 2 into a portion covering the knee joint of the wearer and a portion covering; the shin part of the wearer and gathers the skin about the crotch part toward the knee part on the back side of the wearer. A portion located near the ankle part of the wearer on the outer side face side of the main part 2 is a third start part 3*c* which extends the skin about the greater trochanter of the wearer toward the femoral part.

In thus constructed lower-body garment 1U, the first and, second start parts 3*a*, 3*b* can act so as to enable the hip and knee joints to move smoothly and restrain the body of the wearer from jumping up. This can suppress waste in motions of the wearer and make the motions appear beautiful. The third start part 3*c* can act so as to stabilize the motions of the hip joints of the wearer and restrain the hips from flowing laterally outward from the body. This can suppress waste in, motions of the wearer and make the motions appear beautiful.

Twenty-Second Embodiment

Figure 25:
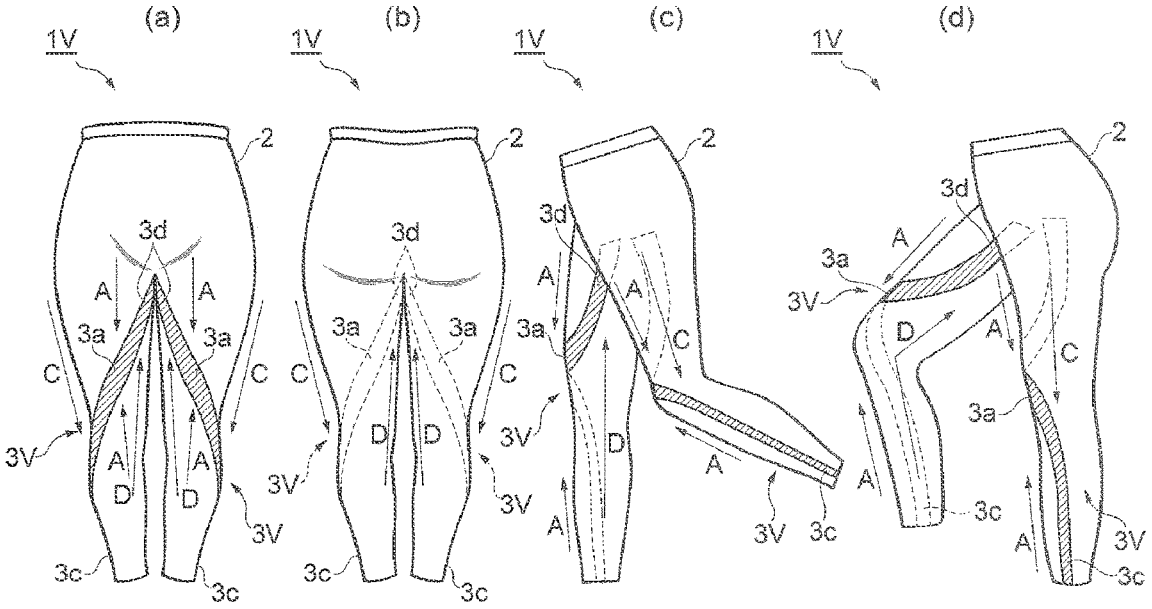
FIG. 25 is a set of diagrams illustrating how the lower-body garment in accordance with a twenty-second embodiment of the present invention is worn.

FIG. 25 is a set of diagrams illustrating how the lower-body garment in accordance with the twenty-second embodiment of the present invention is worn. The depicted lower-body garment 1V differs from the first embodiment in that it is of a type (ACD type) exhibiting the above-mentioned effects A, C, and D. This lower-body garment 1Y is provided with linear expansion/contraction start parts 3V each extending near the crotch part of the wearer on the inner side face side of the main part 2, turns to the front side of the main part 2, travels obliquely about a knee par of the wearer, turns to the outer side face side of the main part 2, and extends to an ankle part of the wearer.

In each expansion/contraction start part 3V, a portion located above the knee part on the front side of the main part 2 is a first start part 3*a* which separates the main part 2 into a portion covering the knee joint of the wearer and a portion covering the femoral part of the wearer and gathers the skin about the knee part toward the knee part while extending the skin about the crotch part toward the knee part on the front side of the wearer. A portion located near the ankle part of the wearer on the outer side face side of the main part 2 is a third start part 3*c* which extends the skin about the greater trochanter of the wearer toward the femoral part, and a portion located near the crotch part on the inner side face side of the main part 2 is a fourth start part 3*d* which gathers the skin on the inner side face side of a leg of the wearer toward the crotch part.

In thus constructed lower-body garment 1V, the first start part 3*a* can act so as to enable the hip and knee joints to move smoothly and restrain the body of the wearer from jumping up. This can suppress waste in motions of the wearer and make the motions appear beautiful. The third and fourth start parts 3*c*, 3*d* can act so as to stabilize the motions of the hip joints of the wearer and restrain the hips from flowing laterally outward from the body. This can suppress waste in motions of the wearer and make the motions appear beautiful.

Twenty-Third Embodiment

Figure 26:
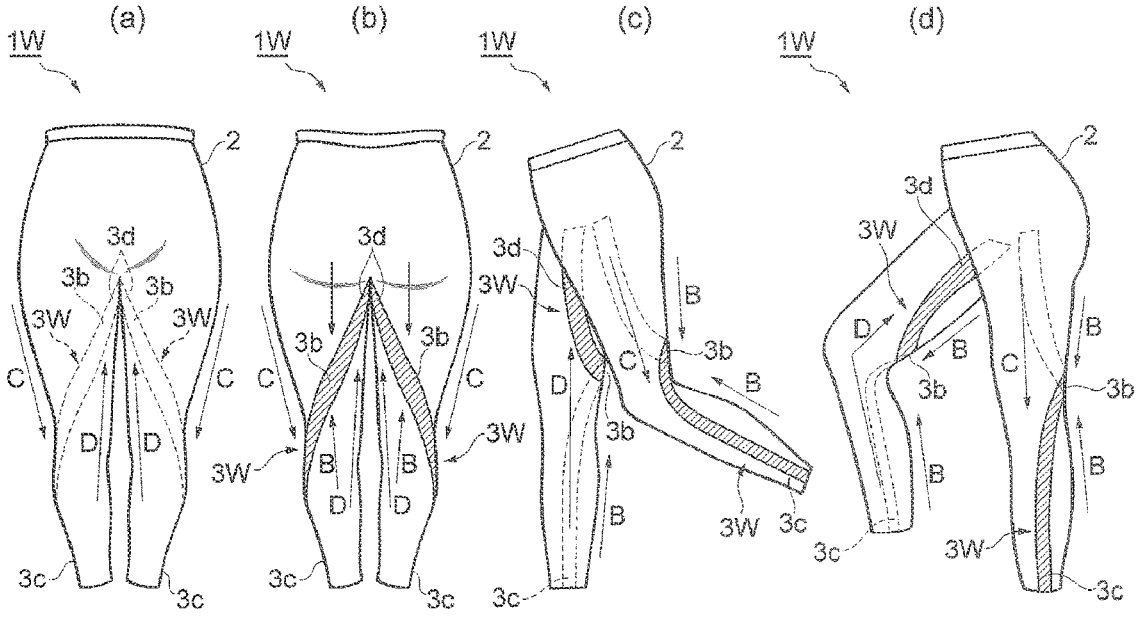
FIG. 26 is a set of diagrams illustrating how the lower-body garment in accordance with a twenty-third embodiment of the present invention is worn.

FIG. 26 is a set of diagrams illustrating how the lower-body garment in accordance with the twenty-third embodiment of the present invention is worn. The depicted lower-body garment 1W differs from the first embodiment in that it is of a type (BCD type) exhibiting the above-mentioned effects B, C, and D. This lower-body garment 1W is provided with linear expansion/contraction start parts 3W each extending near the crotch part of the wearer on the inner side face side of the main part 2, turns to the back side of the main part 2, travels obliquely above a knee part of the wearer, turns to the outer side face side of the main part 2, and extends to an ankle part of the wearer.

In each expansion/contraction start part 3W, a portion located above the knee part on the back side of the main part 2 is a second start part 3*b* which separates the main part 2 into a portion covering the knee joint of the wearer and a portion covering the femoral part of the wearer and gathers the skin about the knee part toward the knee part while extending the skin about the crotch part toward the knee side on the back side of the wearer. A portion located near the ankle part of the wearer on the outer side face side of the main part 2 is a third start part 3*c* which extends the skin about the greater trochanter of the wearer toward the femoral part, and a portion located near the crotch part on the inner side face side of the main part 2 is a fourth start part 3*d* which gathers the skin on the inner side face side of a leg of the wearer toward the crotch part.

In thus constructed lower-body garment 1W, the second start part 3*b* can act so as to enable the hip and knee joints to move smoothly and restrain the body of the wearer from jumping up. This can suppress waste in motions of the wearer and make the motions appear beautiful. The third and fourth start parts 3*c*, 3*d* can act so as to stabilize the motions of the hip joints of the wearer and restrain the hips from flowing laterally outward from the body. This can suppress waste in motions of the wearer and make the motions appear beautiful.

While the above-mentioned embodiments explain examples in which the lower-body garment in accordance with the present invention is actualized as leggings, the present invention is not limited thereto. For example, it may be any of bottom garments such as outer pants, swimwear, and foundation garments such as girdles.

While the above-mentioned embodiments explain examples in which the expansion/contraction start parts appear on the exterior of the leggings, the expansion/contraction start parts may be provided on the skin side of the lower-body garment, for example, so as not to appear on the exterior when the garment is worn.

[Modified Examples of Expansion/Contraction Start Parts]

Figure 27:
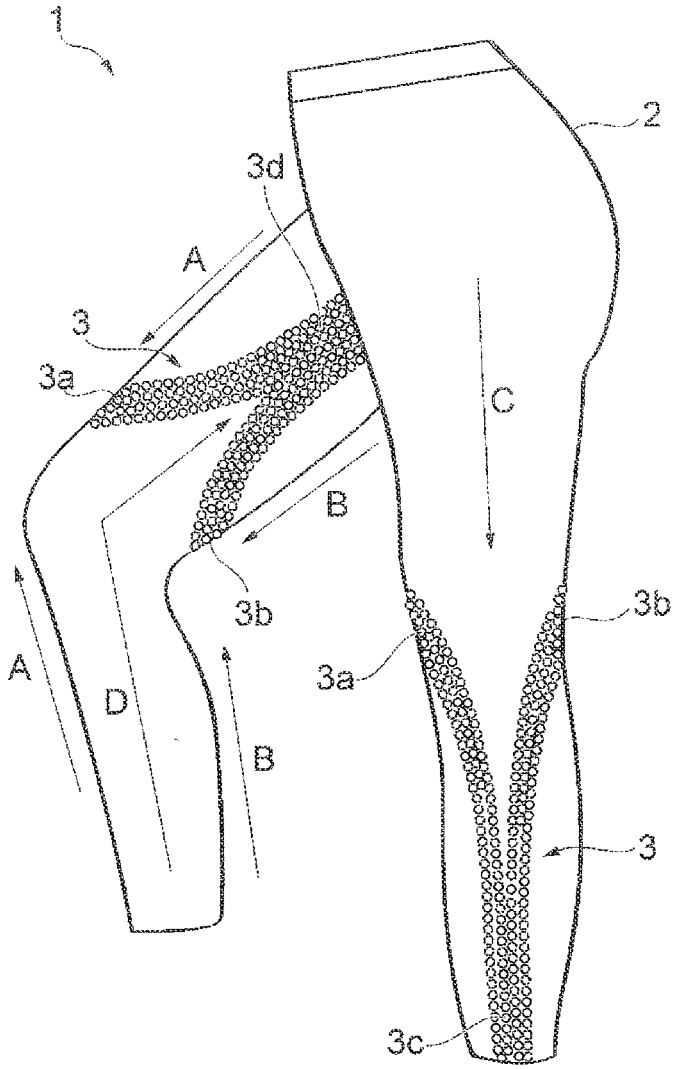
FIG. 27 is a diagram illustrating a modified example of expansion/contraction start parts.
Figure 28:
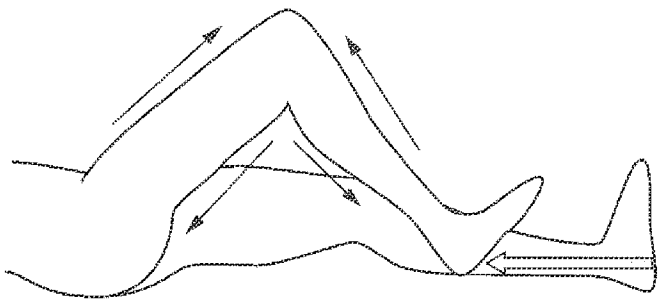
FIG. 28 is a set of diagrams illustrating the relationship between bending/stretching motions of a knee joint and movements of the skin.
Figure 28:
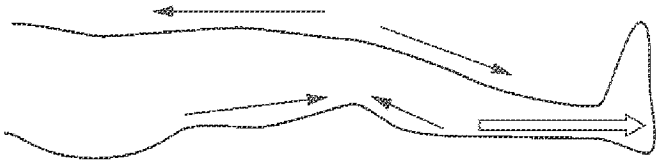
Figure 29:
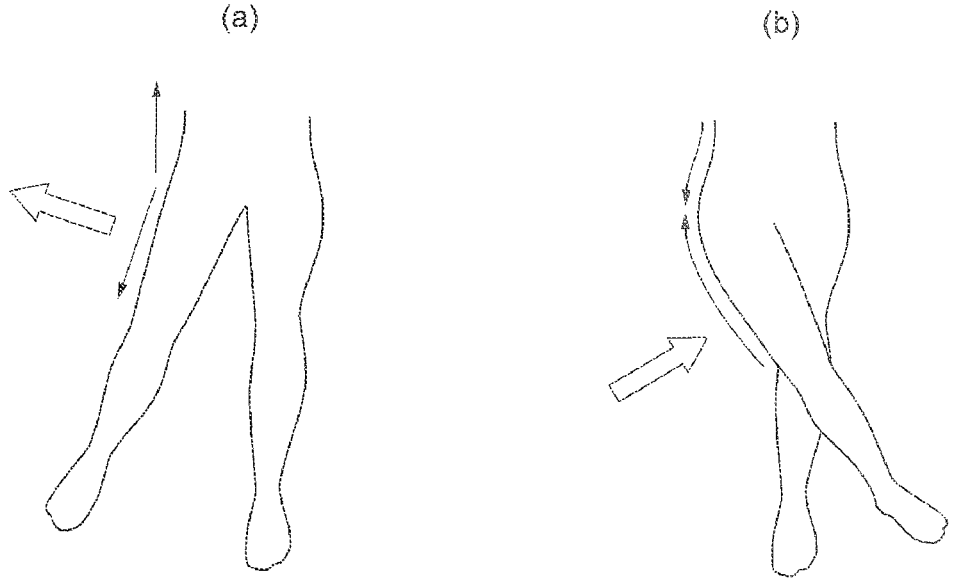
FIG. 29 is a set of diagrams illustrating the relationship between outward/inward turning motions of a hip joint and movements of the skin.

For providing the main part 2 with the expansion/contraction start parts 3, patches constituting the expansion/contraction start parts 3 may be sewn together with a material constituting the main part 2, or printed resins and the like may be bonded to the latter. Parts having predetermined forms of the main part 2 excluding those of the expansion/contraction start parts 3 may be prepared and joined together. The expansion/contraction start parts 3 may also be formed by changing a knitting structure of the main part 2 partly or subjecting the main part 2 to burn-out printing. While the above-mentioned embodiments mainly illustrate linear/annular continuous expansion/contraction start parts 3 each having a fixed width, the expansion/contraction start parts 3 may be partly discontinuous or arranged intermittently like broken lines or dotted lines. For example, as illustrated in FIG. 27, circular materials may be arranged like dots in predetermined regions, so as to form the expansion/contraction start parts 3. In this case, the materials are not limited to circular forms, but may have other forms such as rectangular, triangular, and semicircular forms.

While the lower-body garments 1B to 1E, 1J to 1L, and 1Q of the above-mentioned embodiments illustrate examples in which they are formed such that their lower end parts cover down to the ankle parts of the wearer, they may be made shorter, for example. More specifically, the lower end parts, i.e., hems, of the lower-body garments 1B to 1E, 1J to 1L, and 1Q may be located as low as or lower than the lower end parts of their corresponding expansion/contraction start parts. However, forming the lower-body garment such as to cover down to the ankle parts is preferred, since the skin can be pulled in from a wider area thereby.

INDUSTRIAL APPLICABILITY

The present invention can be utilized in lower-body garments.

REFERENCE SIGNS LIST

1 (1A to 1W): lower-body garment; 2: main part; 3 (3A to 3W): expansion/contraction start part; 3*a*: first start part; 3*b*: second start part; 3*c*: third start part; 3*d*: fourth start part

The invention claimed is:

1. A lower-body garment comprising:

a main part, formed from an elastic material, for coming into close contact with a skin of at least one of femoral and shin parts and for biasing the skin in an expanding and contracting direction, the main part having an inner side face side, an outer side face side, a front side, and a back side; and an expansion and contraction start part, relatively less elastic than the main part, for acting as a start point for expanding and contracting the main part when worn;

wherein the expansion and contraction start part forms one line, extending vertically near the crotch part of a wearer on the inner side face of the main part, leading to a branching portion that branches into the front side and the back side of the main part, the branch portion forming one branch line turning to the front side of the main part, the one branch line traveling obliquely and adapted to cover a knee joint of the wearer, further turning to the outer side face side of the main body, extending such that it is adapted to cover an ankle part of the wearer; the branch portion forming another branch line routed to the back side of the main part, the another branch line traveling obliquely and adapted to cover the knee joint of the wearer, traveling obliquely and adapted to cover the knee joint of the wearer, further turning to the outer side face side of the main part, and extending such that it is adapted to cover the ankle part of the wearer; the expansion and contraction start part having:

a first start part providing the one branch line on the front side of the main part for separating the main part into a portion adapted to cover a knee joint of a wearer and a portion adapted to cover at least one of femoral and shin parts of the wearer;

a second start part providing the another branch line on the back side of the main part for separating the main part into a portion adapted to cover the knee joint of the wearer and a portion adapted to cover at least one of the femoral and shin parts of the wearer;

a third start part on the outer side face side of the main part at least partly extending under the portion adapted to cover the knee joint of the wearer, and extending such that it is adapted to cover the ankle part of the wearer; and a fourth start part on the inner side face side of the main part, forming the one line for extending vertically near the crotch part of the wearer and leading to the branching portion.

2. A lower-body garment according to claim 1, wherein the expansion and contraction part includes a linear part substantially symmetrical along a front-back direction of the main part as seen from the inner side face side and the outer side face side of the main part.

3. A lower-body garment according to claim 1, wherein the expansion and contraction start part is formed by partly changing a knitting structure of the main part.

4. A lower-body garment according to claim 1, wherein the expansion and contraction start part is formed by applying a resin to the main part.

5. A lower-body garment according to claim 1, wherein the expansion and contraction start part is formed by attaching a patch to the main part.

6. A lower-body garment according to claim 1, wherein the expansion and contraction start part is formed by subjecting the main part to burn-out printing.

* * * * *